US009396922B2

(12) United States Patent
Verenchikov et al.

(10) Patent No.: US 9,396,922 B2
(45) Date of Patent: Jul. 19, 2016

(54) ELECTROSTATIC ION MIRRORS

(71) Applicant: LECO Corporation, St. Joseph, MI (US)

(72) Inventors: Anatoly N. Verenchikov, St. Petersburg (RU); Mikhail I. Yavor, St. Petersburg (RU); Timofey V. Pomozov, Arkhangelsk (RU)

(73) Assignee: LECO Corporation, St. Joseph, MI (US)

( * ) Notice: Subject to any disclaimer, the term of this patent is extended or adjusted under 35 U.S.C. 154(b) by 88 days.

(21) Appl. No.: 14/354,859

(22) PCT Filed: Oct. 29, 2012

(86) PCT No.: PCT/US2012/062448

§ 371 (c)(1),
(2) Date: Apr. 28, 2014

(87) PCT Pub. No.: WO2013/063587

PCT Pub. Date: May 2, 2013

(65) Prior Publication Data

US 2014/0312221 A1 Oct. 23, 2014

Related U.S. Application Data

(60) Provisional application No. 61/552,887, filed on Oct. 28, 2011.

(51) Int. Cl.
*H01J 49/40* (2006.01)
*H01J 49/48* (2006.01)
(Continued)

(52) U.S. Cl.
CPC ..... *H01J 49/061* (2013.01); *H01J 49/282* (2013.01); *H01J 49/405* (2013.01); *H01J 49/406* (2013.01)

(58) Field of Classification Search
CPC ..... H01J 49/406; H01J 49/40; H01J 49/0004; H01J 49/0036; H01J 49/282; H01J 49/401; H01J 49/405; H01J 49/0031; H01J 49/004; H01J 49/061; H01J 49/147; H01J 49/408; H01J 49/4245; H01J 49/48; G01N 27/622
USPC ..... 250/282, 287, 294, 281, 283, 286, 288, 250/298, 427
See application file for complete search history.

(56) References Cited

U.S. PATENT DOCUMENTS 7,196,324 B2 * 3/2007 Verentchikov ..... 250/287
7,326,925 B2 * 2/2008 Verentchikov et al. ..... 250/287
(Continued)

FOREIGN PATENT DOCUMENTS

CN 1853255 A 10/2006
CN 101171660 A 4/2008
GB 2403063 A 12/2004
SU 1725289 A1 4/1992

OTHER PUBLICATIONS

Yavor, M. et al: "Planar multi-reflecting time-of-flight mass analyzer with a jig-saw ion path", Physics Procedia, Elsevier, Amsterdam, NL, vol. 1, No. 1, Aug. 1, 2008, pp. 391-400.
(Continued)

*Primary Examiner* — David A Vanore
(74) *Attorney, Agent, or Firm* — Honigman Miller Schwartz and Cohn LLP

(57) ABSTRACT

An electrostatic ion mirror is disclosed providing fifth order time-per-energy focusing. The improved ion mirror has up to 18% energy acceptance at resolving power above 100,000. Multiple sets of ion mirror parameters (shape, length, and voltage of electrodes) are disclosed. Highly isochronous fields are formed with improved (above 10%) potential penetration from at least three electrodes into a region of ion turning. Cross-term spatial-energy time-of-flight aberrations of such mirrors are further improved by elongation of electrode with attracting potential or by adding a second electrode with an attracting potential.

40 Claims, 22 Drawing Sheets

| | | Cap-to-cap | El. # 1 | El. # 2 | El. # 3 | El. # 4 | El. # 5 |
|---|---|---|---|---|---|---|---|
| Mirror with zero gaps | Length/H | 25.475 | 0.1927 | 0.3333 | 0.8021 | 0.5833 | 2.9785 |
| | Potential/(K/q) | | 1.1822 | 1.0388 | 0.8954 | 0 | −1 |
| Mirror with aperture 2nd electrode | Length/H | 25.395 | 0.0250 | 0.0500 | 0.5833 | 0.3375 | 2.8125 |
| | Gap/H | | 0.3333 | 0.3333 | 0.1667 | 0.1667 | 0.1667 |
| | Potential/(K/q) | | 1.1891 | 1.0416 | 0.8725 | 0 | −0.9682 |

(51) Int. Cl.
*H01J 49/06* (2006.01)
*H01J 49/28* (2006.01)

(56) References Cited

U.S. PATENT DOCUMENTS

| | | | | |
|---|---|---|---|---|
| 7,501,621 | B2 * | 3/2009 | Willis et al. | 250/287 |
| 7,772,547 | B2 * | 8/2010 | Verentchikov | 250/287 |
| 2006/0214100 | A1 | 9/2006 | Verentchikov et al. | |
| 2010/0223698 | A1 * | 9/2010 | Bostel et al. | 850/33 |
| 2011/0186729 | A1 | 8/2011 | Verentchikov | |
| 2011/0303841 | A1 * | 12/2011 | Yavor | 250/286 |
| 2013/0068942 | A1 * | 3/2013 | Verenchikov | 250/282 |
| 2013/0206978 | A1 * | 8/2013 | Verenchikov et al. | 250/282 |
| 2014/0014831 | A1 * | 1/2014 | Jaloszynski et al. | 250/282 |
| 2014/0284472 | A1 * | 9/2014 | Verenchikov | 250/282 |
| 2014/0312221 | A1 * | 10/2014 | Verenchikov et al. | 250/282 |

OTHER PUBLICATIONS

International Search Report dated Jul. 31, 2013, relating to PCT/US2012/062448.

Milhail Yavor, Anatoli Verentchikov, Juri Hasin, Boris Kozlov, Mikhail Gavrik, and Andrey Trufanov, "Planer multi-reflecting time-of-flight mass analyzer with a jig-saw ion path," Physics Procedia, vol. 1, No. 1, (2008), pp. 391-400.

Japanese Office Action for Application No. 2014-539118 dated Jun. 2, 2015 with its English translation thereof.

Notification of the First Office Action issued by the State Intellectual Property Office of the People's Republic of China dated Sep. 6, 2015, regarding Application No. 201280053166.9, together with English translation.

* cited by examiner

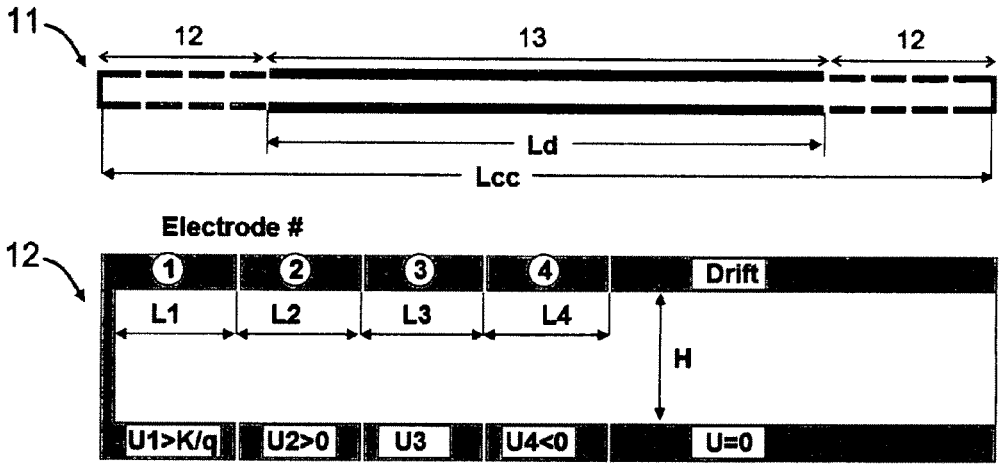
Lcc/H = 20.32; Gaps = 0
| Electrode # | 1 | 2 | 3 | 4 | Drift region |
|---|---|---|---|---|---|
| Lengths Li/H | 0.9167 | 0.9167 | 0.9167 | 0.9167 | 13 |
| Vi at T\|K=T\|KK=T\|KKK=0 | 1.3607 | 0.9693 | -0.1391 | -1.898 | 0 |
| Vi at T\|K=T\|KKK=0; T\|KK= -0.0142 | 1.36 | 0.9691 | -0.1184 | -1.892 | 0 |
*Fig.1-A Prior Art*
| Aberrations (normalized by TOF) | Mirror with 3rd order focusing | |
|---|---|---|
| | Coefficient | Magnitude $\times 10^6$ |
| (T\|YYK) | 0.07242 | 16.97 |
| (T\|BBK) | 6.384 | 3.448 |
| (T\|YYKK) | −0.4595 | −6.462 |
| (T\|BBKK) | −85.51 | −2.770 |
| (T\|KKKK) | 11.44 | 148.2 |
| (T\|YYKKK) | −14.19 | −11.97 |
| (T\|BBKKK) | −560.8 | −1.090 |
| (T\|KKKKK) | 8.452 | 65.75 |
| (T\|KKKKKK) | −114.7 | −5.350 |
*Fig.1-B Prior Art* after a pair of mirror reflections:
Spatial and chromatic focusing:
$(Y|B) = (Y|K) = 0$; $(Y|BB) = (Y|BK) = (Y|KK) = 0$;
$(B|Y) = (B|K) = 0$; $(B|YY) = (B|YK) = (B|KK) = 0$;
First order time of-flight focusing
$(T|Y) = (T|B) = (T|K) = 0$;
Second order time-of-flight focusing, including cross terms
$(T|BB) = (T|BK) = (T|KK) = (T|YY) = (T|YK) = (T|YB) = 0$;
And third order time per energy focusing:
$(T|K) = (T|KK) = (T|KKK) = 0$
*Fig.1-C Prior Art*
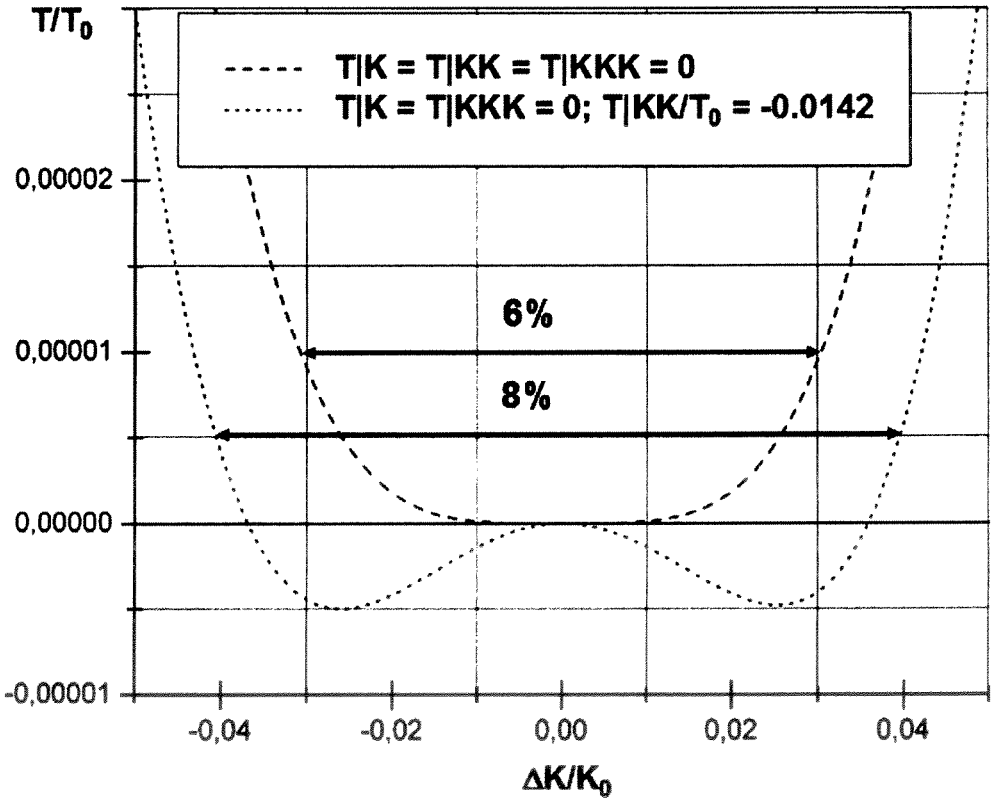
*Fig.1-D Prior Art*

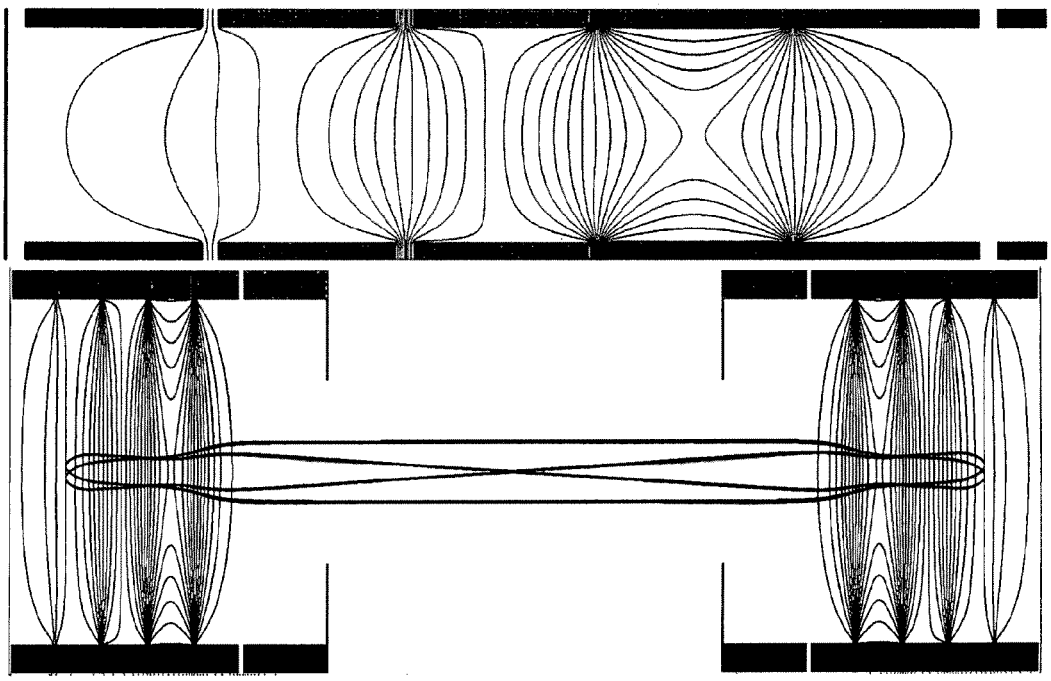
*Fig.1-E Prior Art*
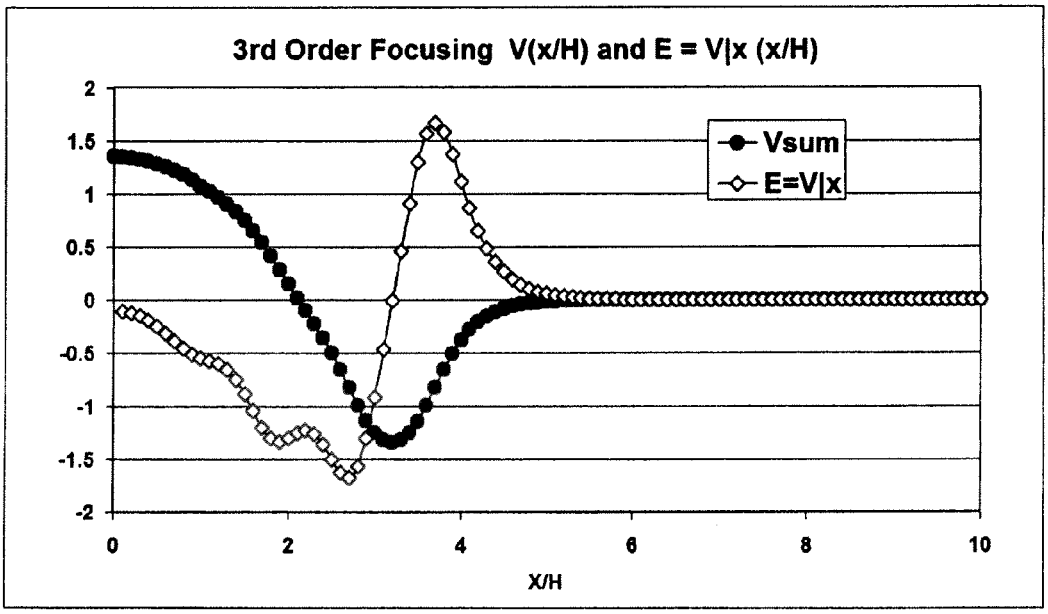
*Fig.1-F Prior Art*

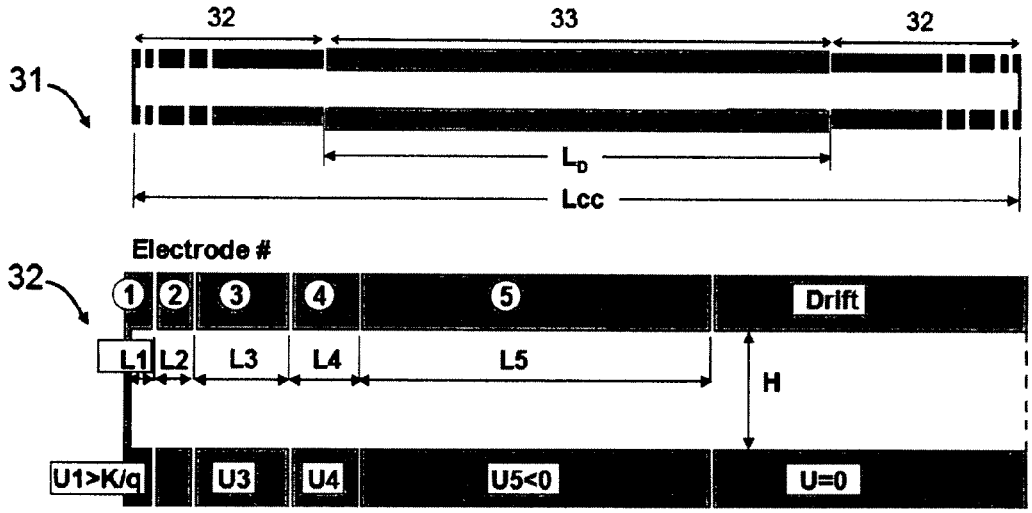

| | Lcc/H | L1/H | L2/H | L3/H | L4/H | L5/H |
|---|---|---|---|---|---|---|
| (T\|K)=(T\|KK)=(T\|KKK)=(T\|KKKK)=(T\|KKKKK)=0 | 25.475 | 0.1927 | 0.3333 | 0.8021 | 0.5833 | 2.9785 |
| (T\|K)=(T\|KKK)=(T\|KKKKK)=0, (T\|KK)/$T_0$=0.00525, (T\|KKKK)/$T_0$= −1.727 | 25.642 | 0.1791 | 0.3423 | 0.8186 | 0.5833 | 2.9785 |

| | V1 | V2 | V3 | V4 | V5 |
|---|---|---|---|---|---|
| (T\|K)=(T\|KK)=(T\|KKK)=(T\|KKKK)=(T\|KKKKK)=0 | 1.1822 | 1.0388 | 0.8954 | 0 | −1 |
| (T\|K)=(T\|KKK)=(T\|KKKKK)=0, (T\|KK)/$T_0$=0.00525, (T\|KKKK)/$T_0$= −1.727 | 1.1796 | 1.0437 | 0.8934 | 0 | −0.9864 |

*Fig.3-A*

| Aberrations (normalized by TOF) | Mirror with 3rd order energy focusing | | Mirror with 5th order energy focusing | |
|---|---|---|---|---|
| | Aberration Coefficient | Magnitude $\times 10^6$ | Aberration Coefficient | Magnitude $\times 10^6$ |
| (T\|YYK) | 0.07242 | 16.97 | 0.05536 | 12.97 |
| (T\|BBK) | 6.384 | 3.448 | 12.90 | 6.965 |
| (T\|YYKK) | −0.4595 | −6.462 | 0.09198 | 1.293 |
| (T\|BBKK) | −85.51 | −2.770 | −68.13 | −2.207 |
| (T\|KKKK) | 11.44 | 148.2 | | |
| (T\|YYKKK) | −14.19 | −11.97 | −2.170 | −1.832 |
| (T\|BBKKK) | −560.8 | −1.090 | | |
| (T\|KKKKK) | 8.452 | 65.75 | | |
| (T\|KKKKKK) | −114.7 | −5.350 | 142.5 | 6.648 |

*Fig.3-B*

After a pair of mirror reflections:
Spatial and chromatic focusing:
(Y|B) = (Y|K) = 0; (Y|BB) = (Y|BK) = (Y|KK) = 0;
(B|Y) = (B|K) = 0; (B|YY) = (B|YK) = (B|KK) = 0;
First order time of-flight focusing
(T|Y) = (T|B) = (T|K) = 0;
Second order time-of-flight focusing, including cross terms
(T|BB) = (T|BK) = (T|KK) = (T|YY) = (T|YK) = (T|YB) = 0;
And third order time per energy focusing:
(T|K) = (T|KK) = (T|KKK) = 0
And the fifth-order time-per-energy focusing:
(T|KKKK) = (T|KKKKK) = 0

*Fig.3-C*

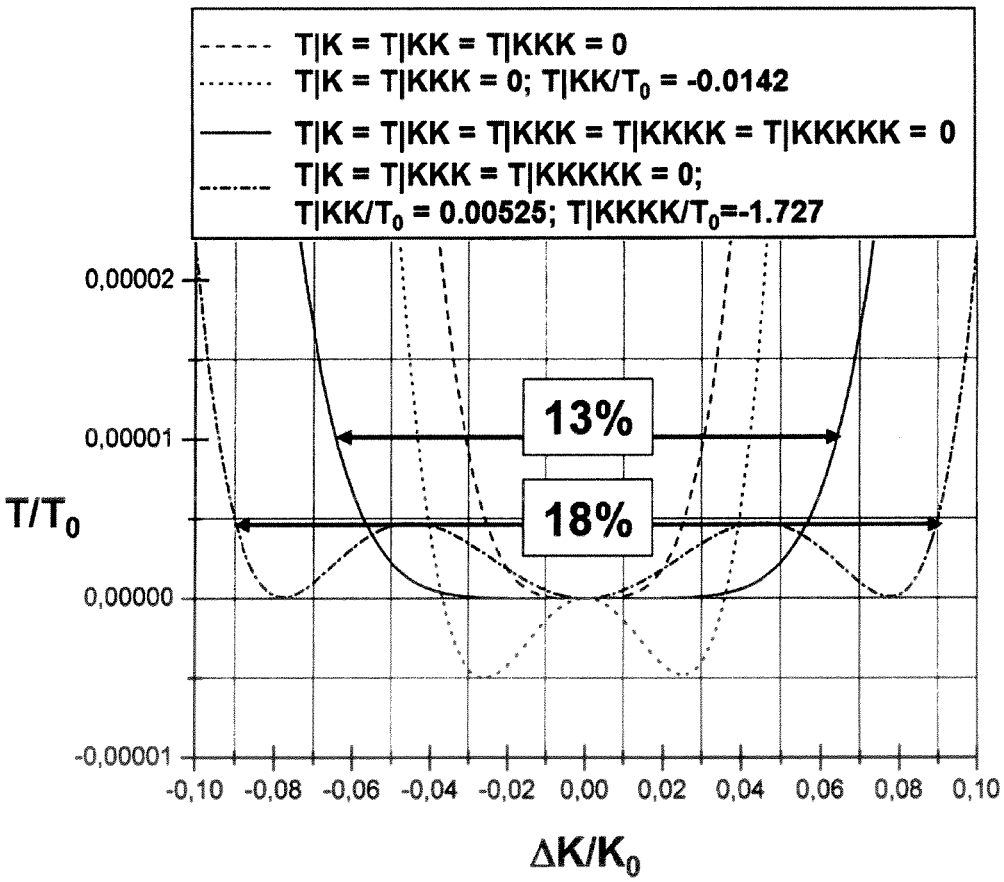

*Fig.3-D*

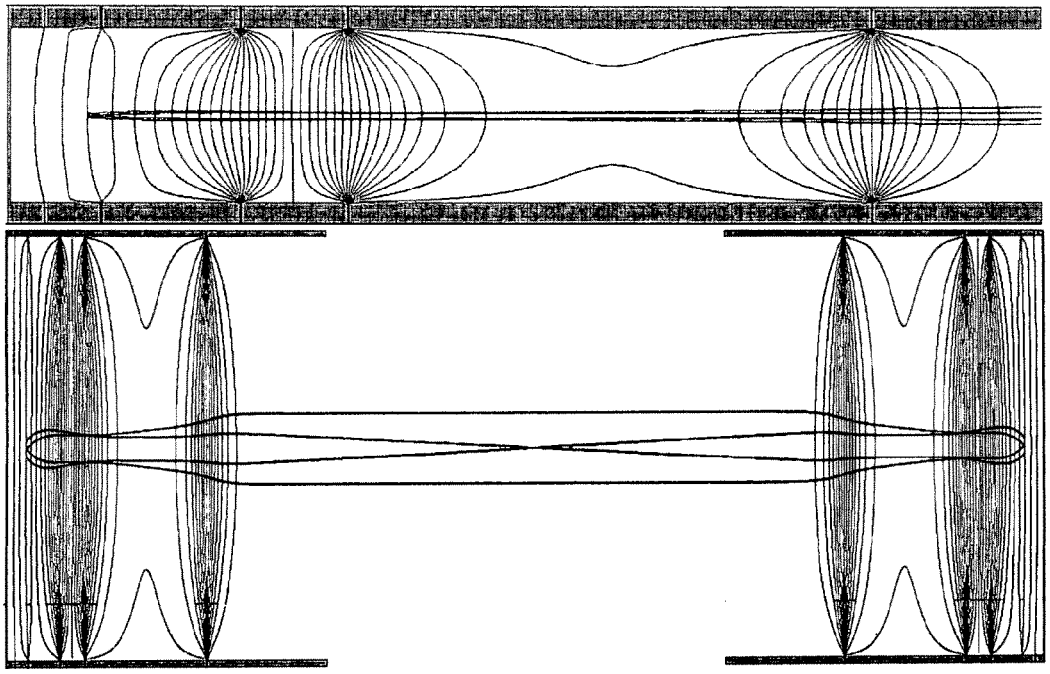
*Fig.3-E*
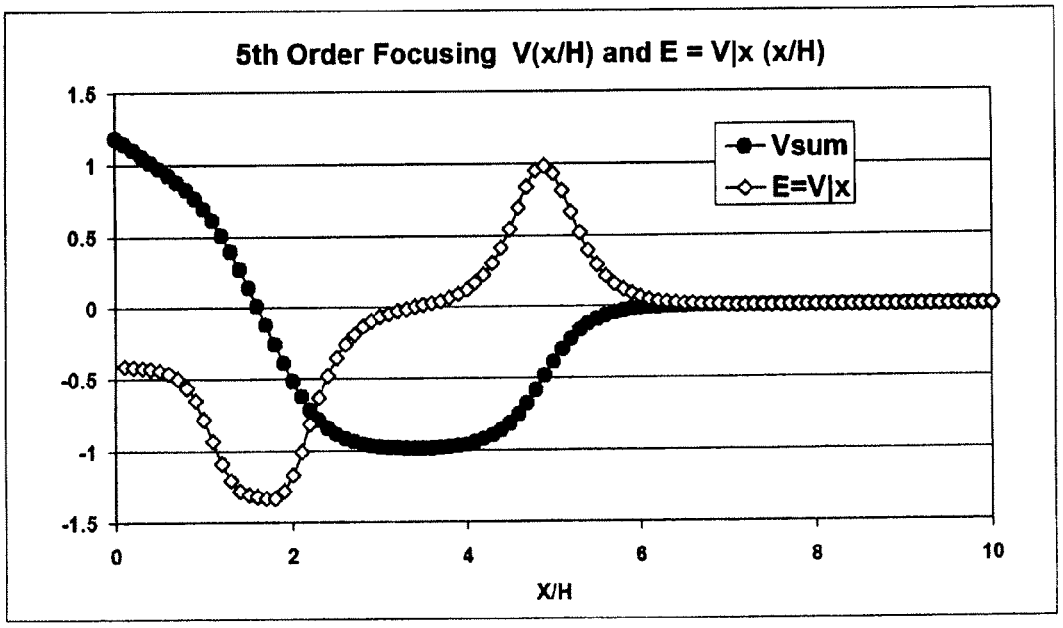
*Fig.3-F*

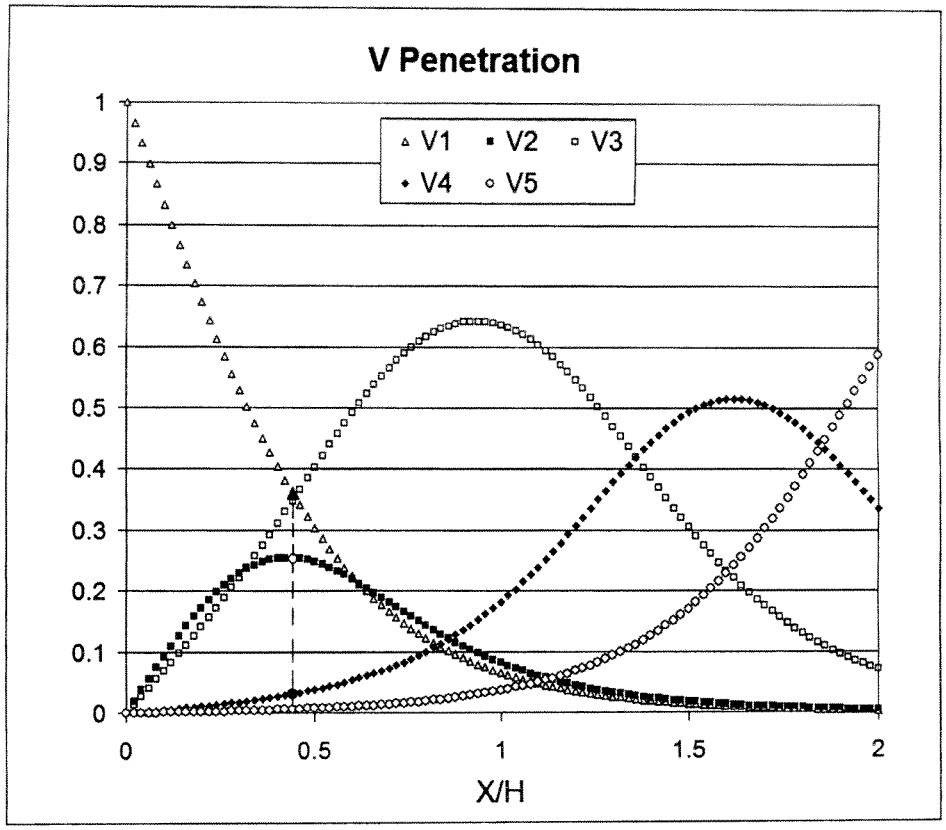
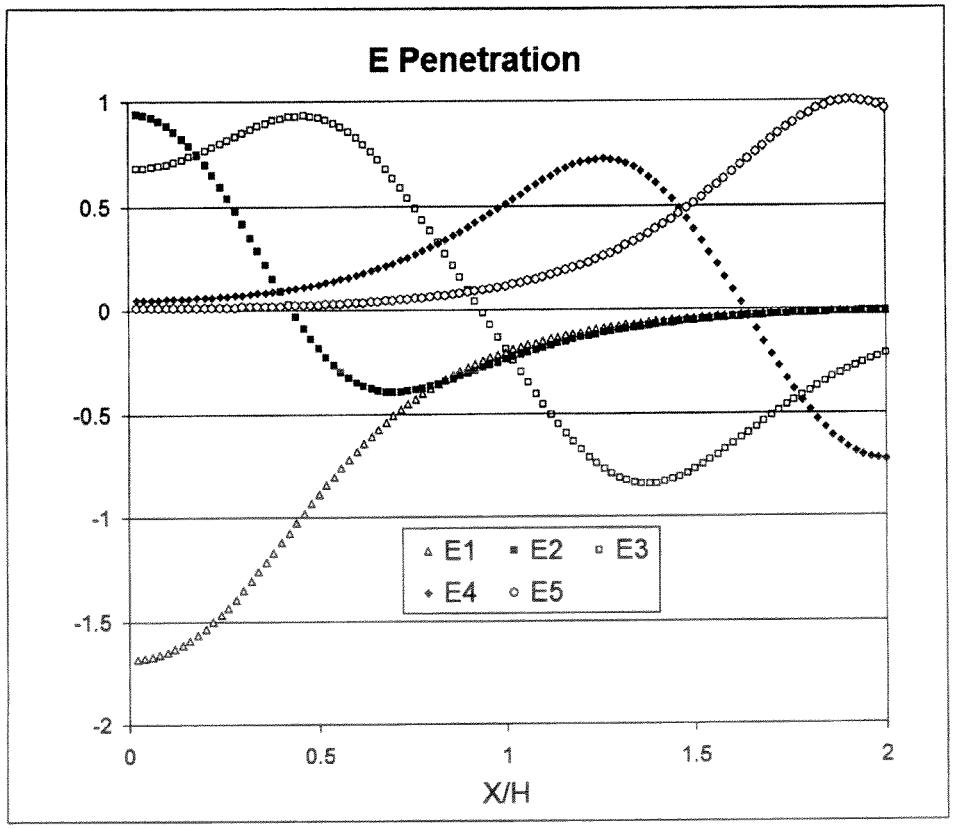
*Fig.4-B*

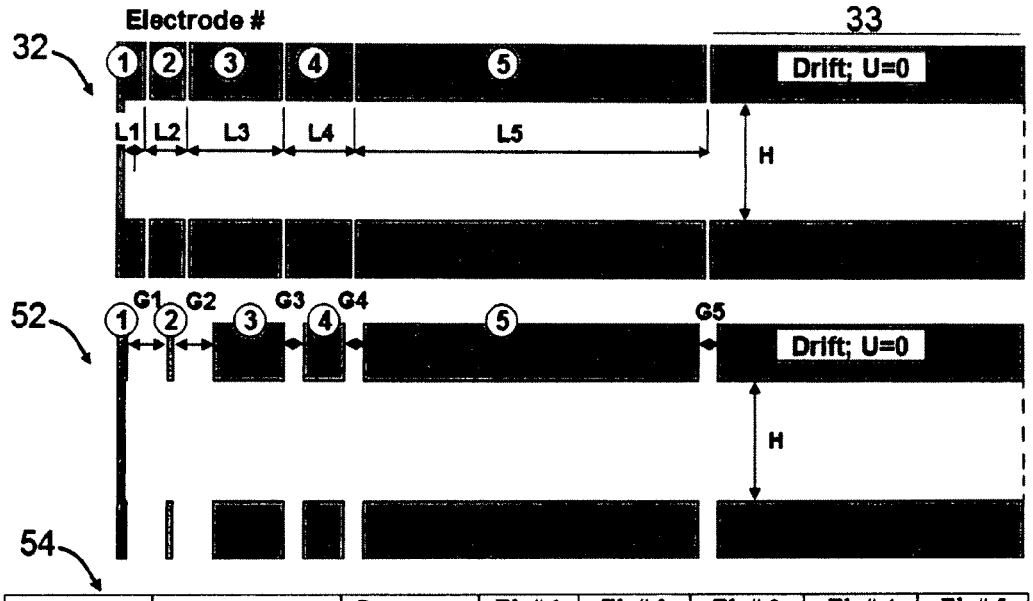
| | | Cap-to-cap | El. # 1 | El. # 2 | El. # 3 | El. # 4 | El. # 5 |
|---|---|---|---|---|---|---|---|
| Mirror with zero gaps | Length/H | 25.475 | 0.1927 | 0.3333 | 0.8021 | 0.5833 | 2.9785 |
| | Potential/(K/q) | | 1.1822 | 1.0388 | 0.8954 | 0 | –1 |
| Mirror with aperture 2nd electrode | Length/H | 25.395 | 0.0250 | 0.0500 | 0.5833 | 0.3375 | 2.8125 |
| | Gap/H | | 0.3333 | 0.3333 | 0.1667 | 0.1667 | 0.1667 |
| | Potential/(K/q) | | 1.1891 | 1.0416 | 0.8725 | 0 | –0.9682 |
*Fig. 5-A*
| Aberrations (normalized by TOF) | Mirror with 5 order focusing (narrow gaps) | | Mirror with 5 order focusing (large gaps) | |
|---|---|---|---|---|
| | Coefficient | Magnitude $\times 10^6$ | | |
| (T\|YYK) | 0.05536 | 12.97 | 0.06717 | 15.74 |
| (T\|BBK) | 12.90 | 6.965 | 13.86 | 7.485 |
| (T\|YYKK) | 0.09198 | 1.293 | | |
| (T\|BBKK) | –68.13 | –2.207 | –78.88 | –2.556 |
| (T\|KKKK) | | | | |
| (T\|YYKKK) | –2.170 | –1.832 | –2.200 | –1.856 |
| (T\|BBKKK) | | | | |
| (T\|KKKKK) | | | | |
| (T\|KKKKKK) | 142.5 | 6.648 | 123.2 | 5.748 |
*Fig. 5-B*

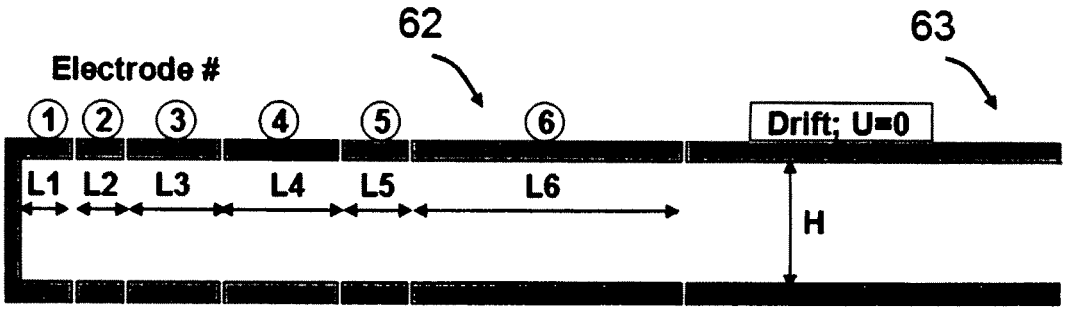
| | Lcc | El. # 1 | El. # 2 | El. # 3 | El. # 4 | El. # 5 | El. # 6 |
|---|---|---|---|---|---|---|---|
| Length/H | 27.68 | 0.4533 | 0.4233 | 0.8000 | 0.9800 | 0.5833 | 2.2867 |
| Potential/(K/q) | | 1.2889 | 1.0571 | 0.9095 | 0 | −1.5625 | −0.9702 |
*Fig. 6-A*
| Aberrations (normalized by TOF) | Mirror with 5 order focusing (1 negative potential) | | Mirror with 5 order focusing (2 negative potentials) | |
|---|---|---|---|---|
| | Aberration Coefficient | Magnitude $\times 10^6$ | Aberration Coefficient | Magnitude $\times 10^6$ |
| (T\|YYK) | 0.05536 | 12.97 | 0.03457 | 8.102 |
| (T\|BBK) | 12.90 | 6.965 | 9.490 | 5.124 |
| (T\|YYKK) | 0.09198 | 1.293 | 0.1366 | 1.921 |
| (T\|BBKK) | −68.13 | −2.207 | −37.95 | −1.230 |
| (T\|KKKK) | | | | |
| (T\|YYKKK) | −2.170 | −1.832 | −1.430 | −1.207 |
| (T\|BBKKK) | | | | |
| (T\|KKKKK) | | | | |
| (T\|KKKKKK) | 142.5 | 6.648 | 354.3 | 16.53 |
*Fig. 6-B*

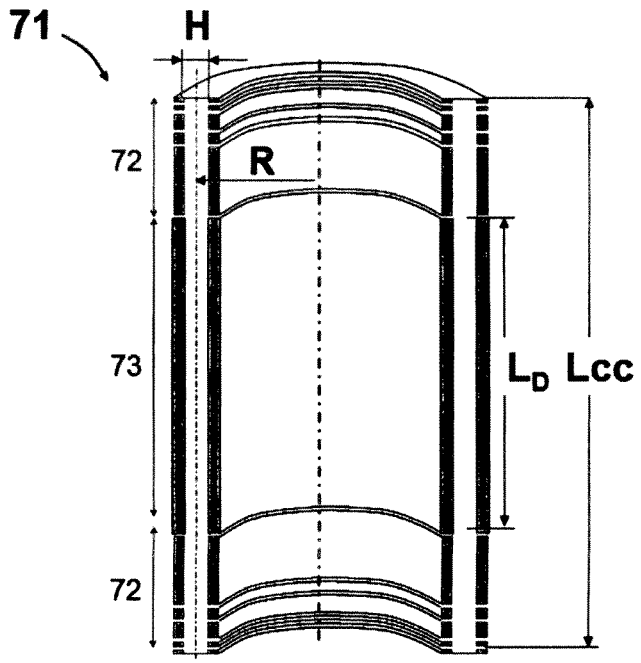
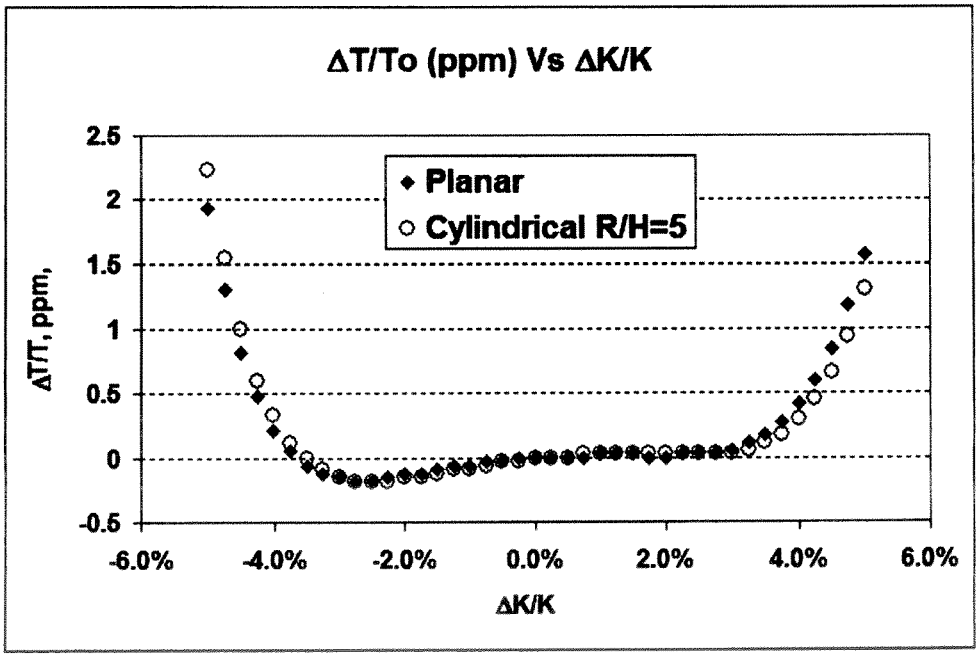
| | R/H | V1 | V3 | Resolution |
|---|---|---|---|---|
| planar | infinity | 9428.95 | 7177.35 | 428,700 |
| cylindrical | 5.75 | 9429.2 | 7177.95 | 413,500 |
| cylindrical | 4.92 | 9429.1 | 7177.95 | 306,800 |
| cylindrical | 4.25 | 9429 | 7178.2 | 274,400 |
*Fig. 7*

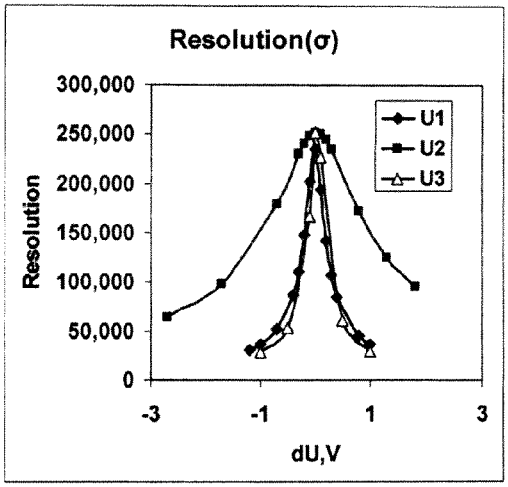
*Fig.8-A*
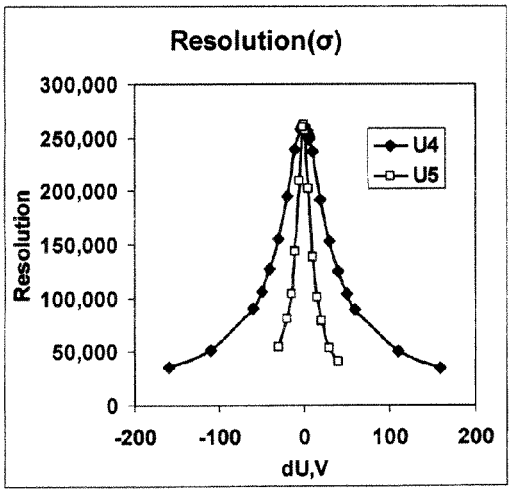
*Fig.8-B*
| | Derivatives of T\|K^n per | | | | | | dV1 | dV2 | dV3 | Sum | Magnitude |
|---|---|---|---|---|---|---|---|---|---|---|---|
| | V1 | V2 | V3 | L1/H | L2/H | L3/H | 0.01 | 0.01 | 0.0101 | | (PPM) |
| (T\|D)/T0 | -2.33 | 0.886 | 1.43 | 0.149 | 0.265 | 0.0483 | -0.0233 | 0.0089 | 0.0144 | 3E-06 | 0.15 |
| (T\|DD)/T0 | -5.23 | 9.44 | -4.18 | 0,516 | -0.03 | -1,40 | -0.0523 | 0.0944 | -0.0422 | -0.0001 | -0.295 |
| (T\|DDD)/T0 | 8.06 | 1.39 | -8.92 | 0.833 | -4.36 | 7.2 | 0.0806 | 0.0139 | -0.0901 | 0.0044 | 0.551 |
| (T\|DDDDD)/T0 | 79.6 | -174 | 95 | -1,07 | -7.81 | -13.8 | 0.796 | -1.74 | 0.9595 | 0.0155 | 0.096875 |
| (T\|DDDDD)/T0 | -246 | -421 | -204 | 7.66 | 140 | -72.6 | -2.46 | -4.21 | -2.0604 | -8.7304 | -2.72825 |
*Fig.8-C*

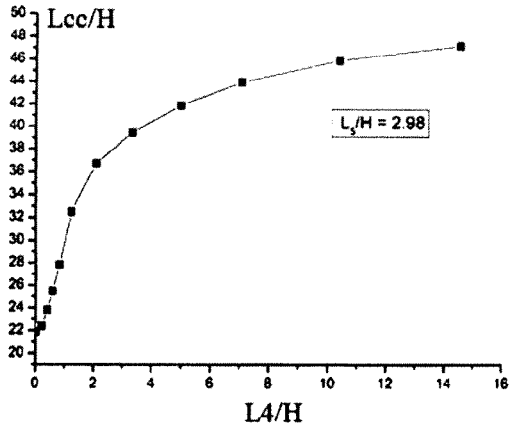
*Fig.9-A*
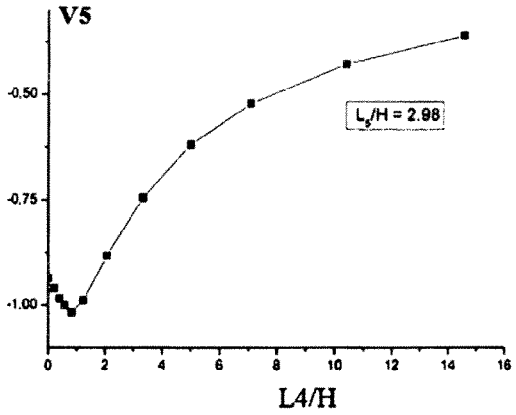
*Fig.9-B*
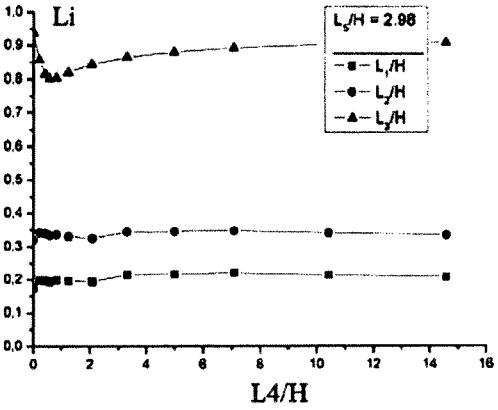
*Fig.9-C*
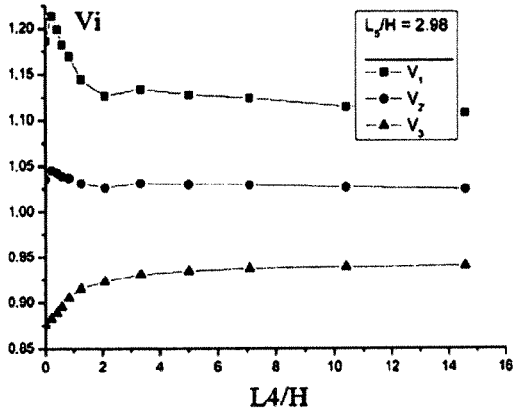
*Fig.9-D*
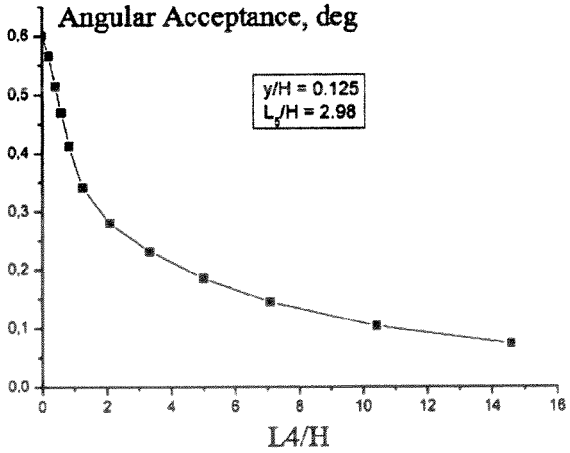
*Fig.9-E*

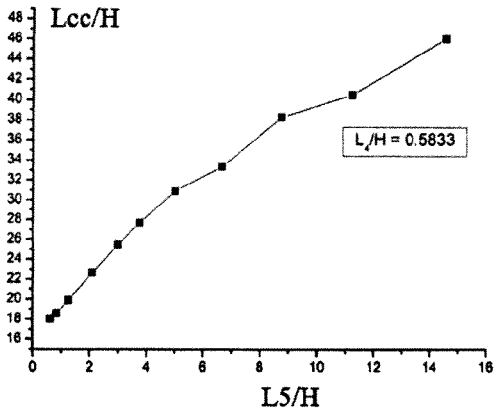
*Fig.10-A*
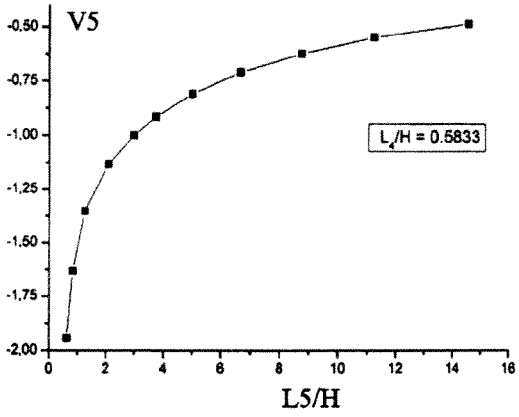
*Fig.10-B*
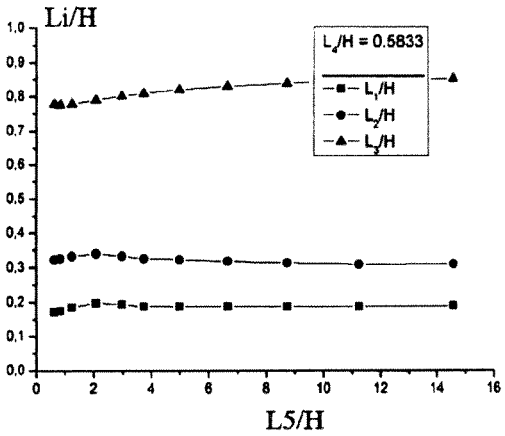
*Fig.10-C*
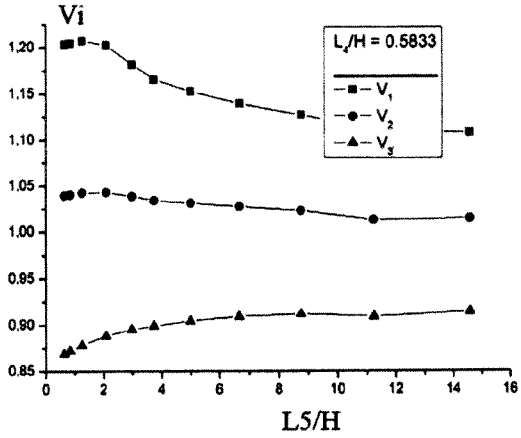
*Fig.10-D*
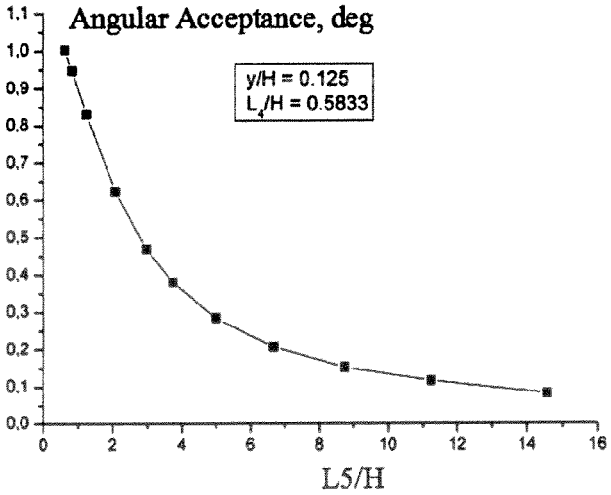
*Fig.10-E*

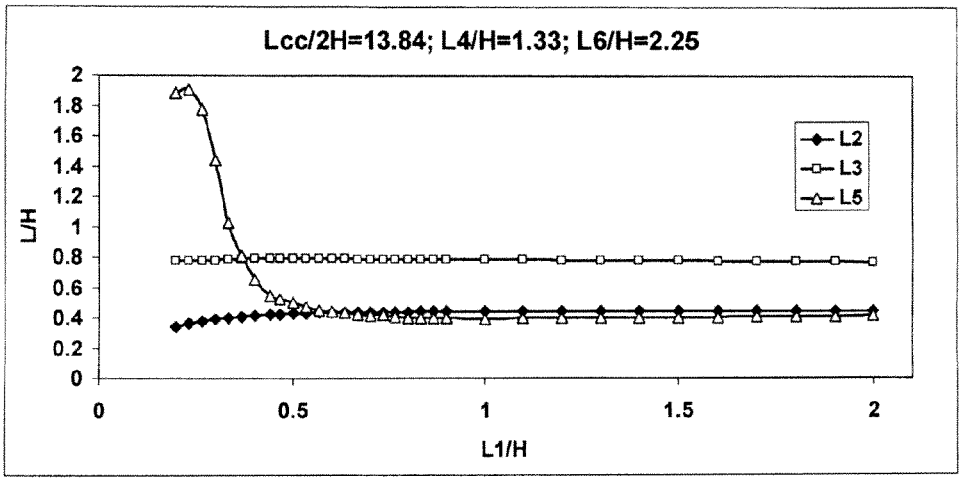
*Fig.11-A*
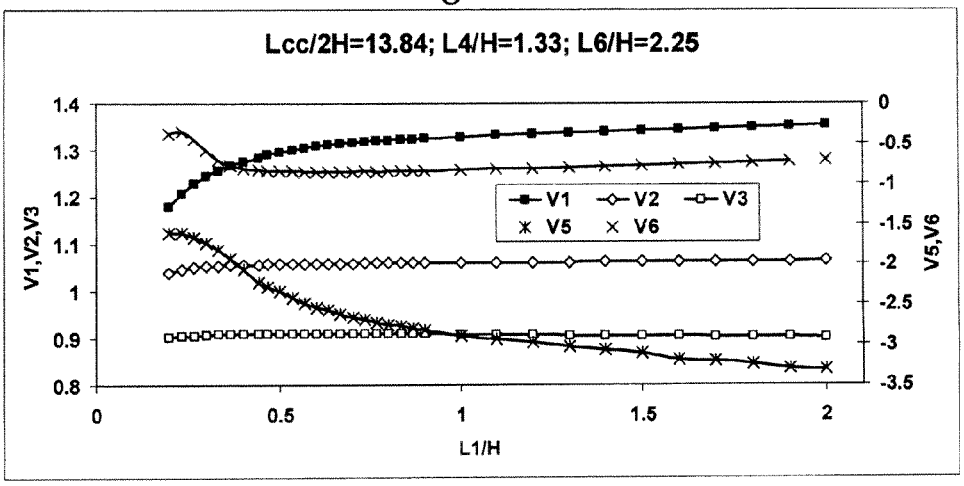
*Fig.11-B*
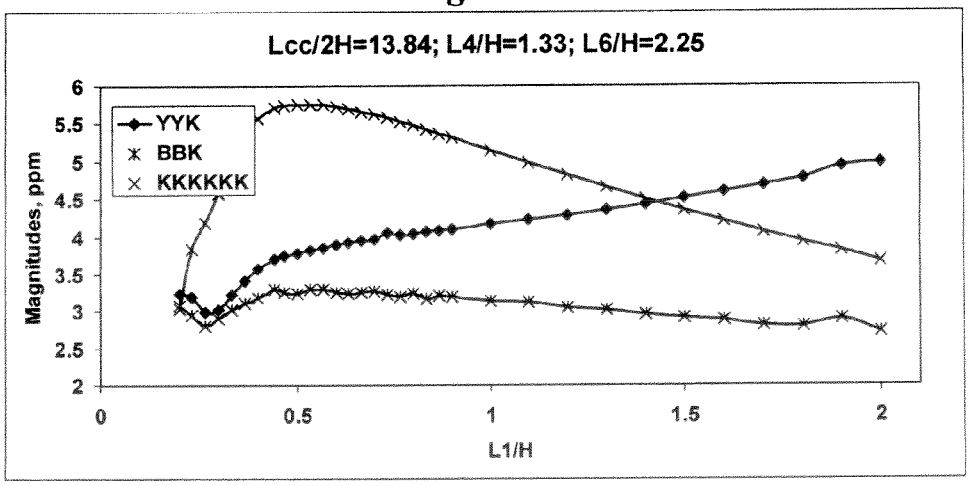
*Fig.11-C*

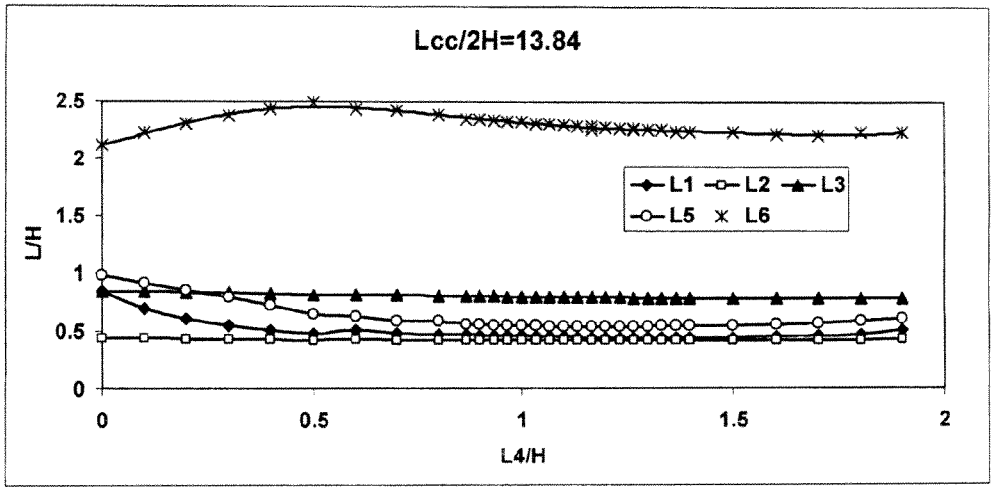
*Fig.12-A*
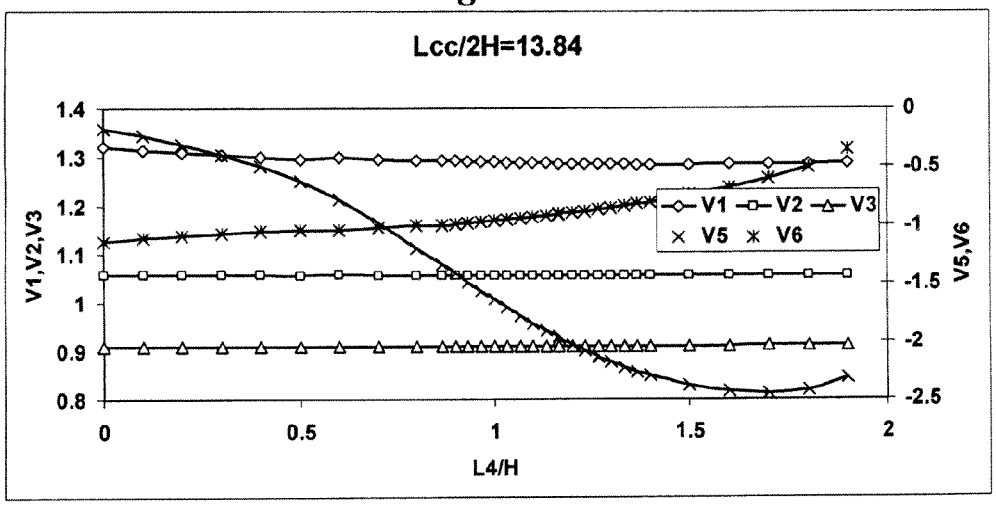
*Fig.12-B*
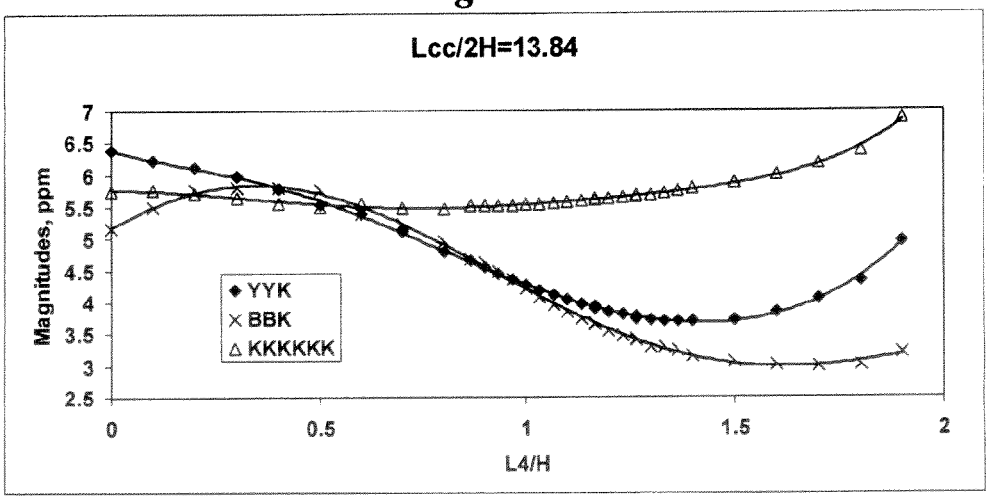
*Fig.12-C*

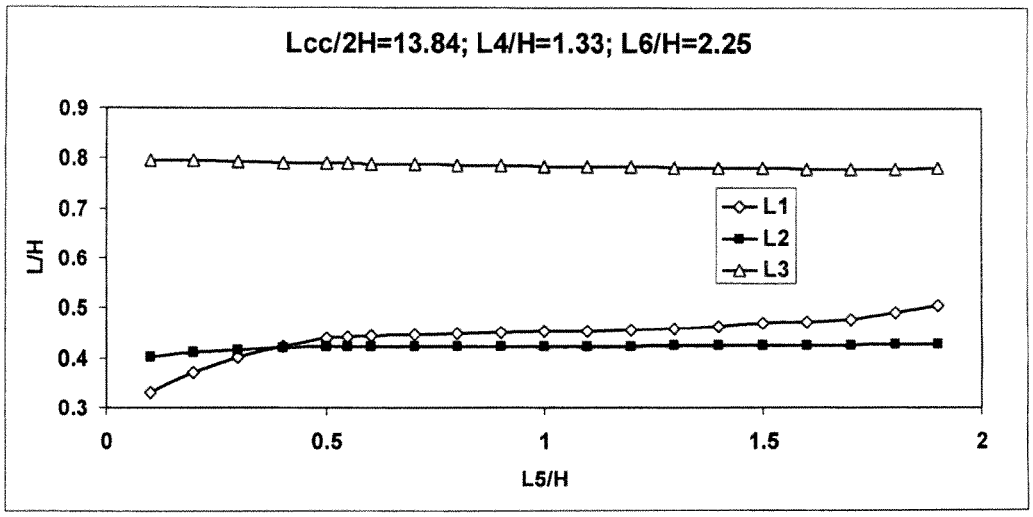
*Fig.13-A*
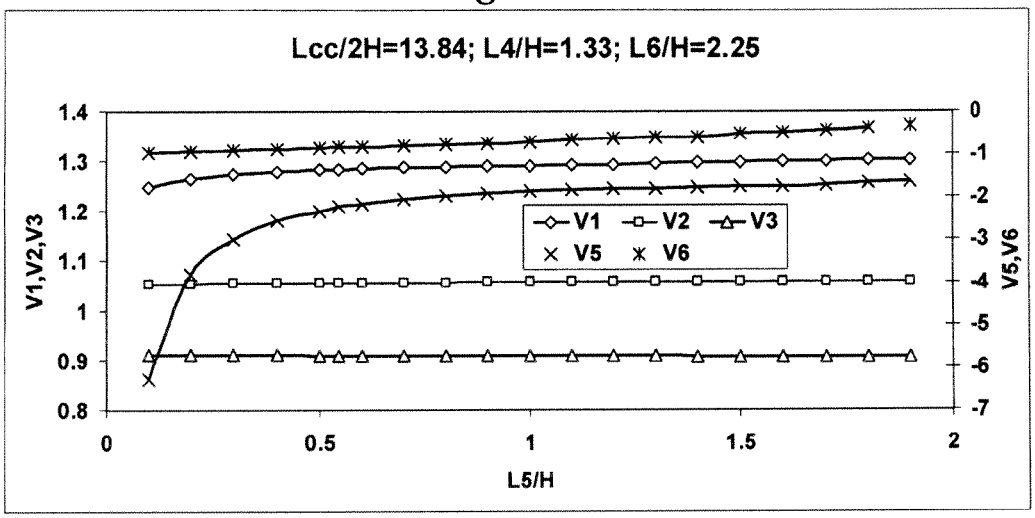
*Fig.13-B*
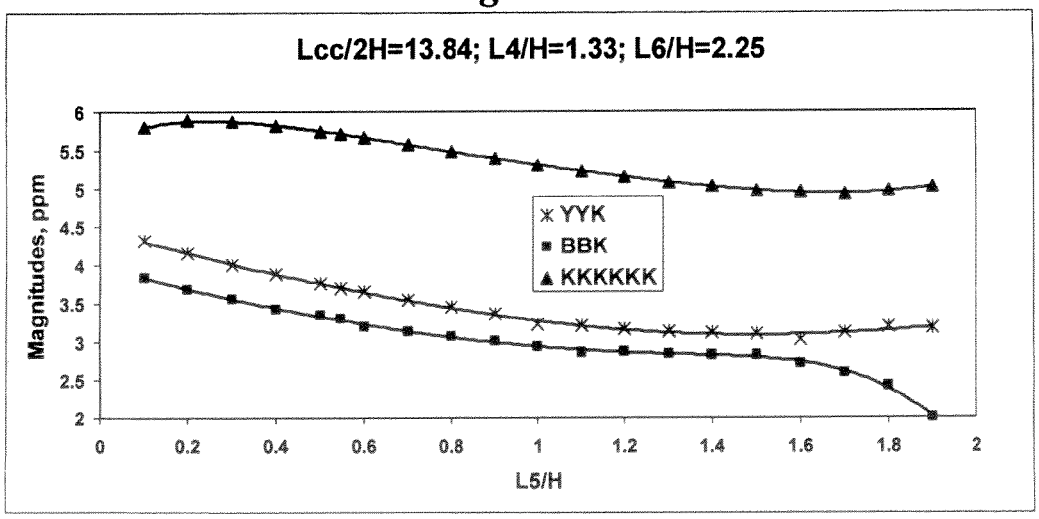
*Fig.13-C*

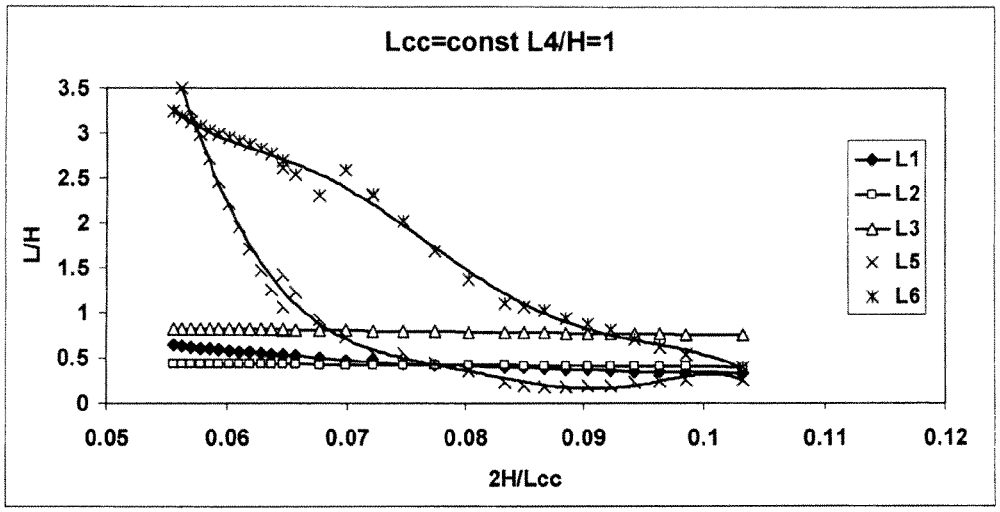
*Fig.14-A*
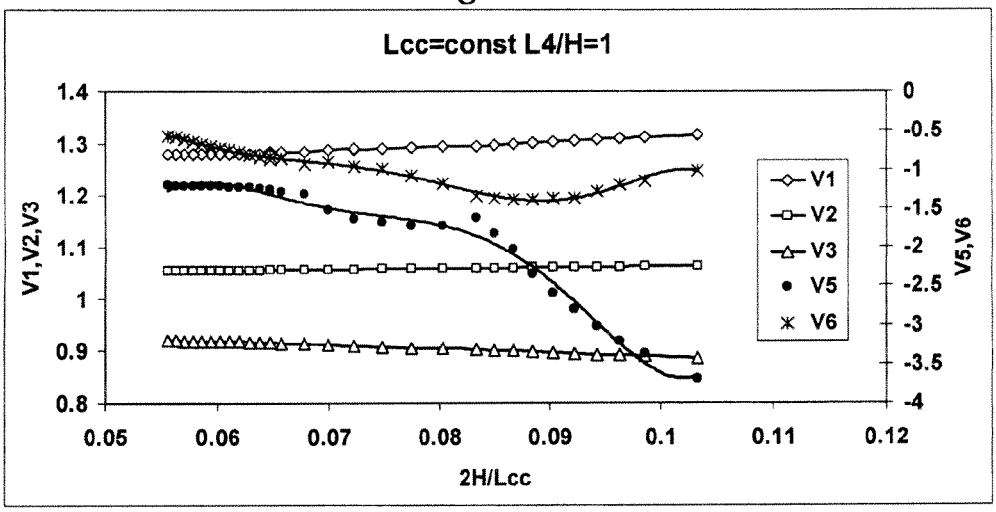
*Fig.14-B*
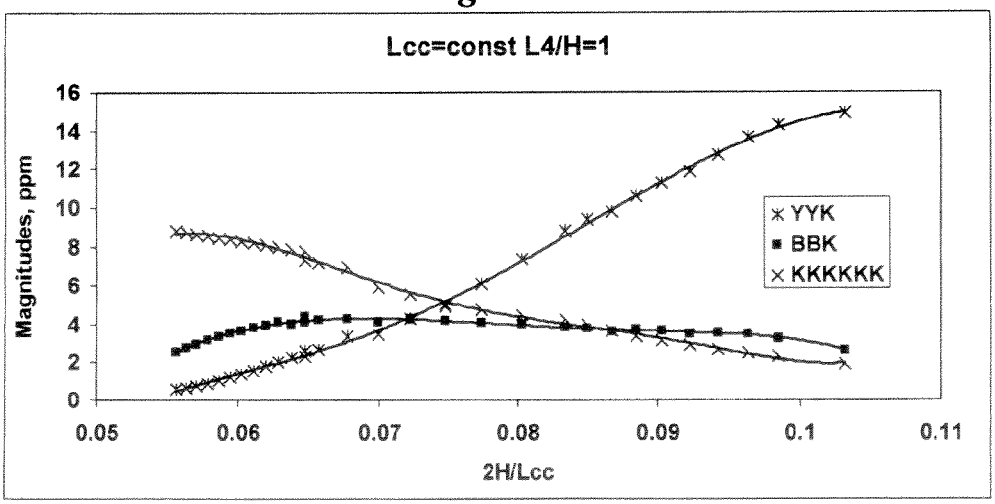
*Fig.14-C*

| | | Mirror Parameters | | | | | | | | | | | | | | | Penetration, % | | | |
|---|---|---|---|---|---|---|---|---|---|---|---|---|---|---|---|---|---|---|---|---|
| | | Lcc/H | L1/H | L2/H | L3/H | L4/H | L5/H | L6/H | Ld/2H | V1 | V2 | V3 | V4 | V5 | V6 | Vd | V1 | V2 | V3 | V4 |
| Fig.3 | | 25.5 | 0.19 | 0.38 | 0.8 | 0.58 | 2.98 | 0 | 7.82 | 1.18 | 1.04 | 0.9 | 0 | -1 | 0 | 0 | | | | |
| Fig.5 | | 25.4 | 0.19 | 0.38 | 0.83 | 0.5 | 2.98 | 0 | 7.82 | 1.19 | 1.04 | 0.87 | 0 | -0.97 | 0 | 0 | 37% | 26% | 34% | 3% |
| Fig.6 | | 27.7 | 0.45 | 0.42 | 0.8 | 0.98 | 0.58 | 2.29 | 8.33 | 1.289 | 1.06 | 0.91 | 0 | -1.56 | -0.97 | 0 | | | | |
| Fig9 | Max | 22 | 0.2 | 0.35 | 0.8 | 0 | 2.98 | 0 | 6.67 | 1.21 | 1.05 | 0.88 | 0 | -1 | 0 | 0 | | | | |
| | Min | 47 | 0.22 | 0.32 | 0.9 | 15 | 2.98 | 0 | 4.08 | 1.12 | 1.03 | 0.93 | 0 | -0.37 | 0 | 0 | | | | |
| Fig.10 | Max | 18 | 0.17 | 0.34 | 0.77 | 0.58 | 0.5 | 0 | 6.64 | 1.22 | 1.05 | 0.84 | 0 | -2 | 0 | 0 | | | | |
| | Min | 47 | 0.2 | 0.31 | 0.82 | 0.58 | 15 | 0 | 6.59 | 1.12 | 1.03 | 0.91 | 0 | -0.5 | 0 | 0 | | | | |
| Fig.11 | Max | 27.7 | 0.2 | 0.37 | 0.8 | 1.33 | 1.9 | 2.25 | 7.00 | 1.18 | 1.03 | 1.17 | 0 | -1.5 | -0.03 | 0 | 41% | 28% | 36% | 3% |
| | Min | 27.7 | 2 | 0.41 | 0.8 | 1.33 | 0.38 | 2.25 | 6.68 | 1.37 | 1.07 | 1.35 | 0 | -3.3 | -0.7 | 0 | 34% | 24% | 33% | 0% |
| Fig.12 | Max | 27.7 | 0.9 | 0.45 | 0.82 | 0 | 1 | 2.1 | 8.58 | 1.32 | 1.07 | 0.91 | 0 | -0.2 | -1.08 | 0 | 46% | 26% | 35% | 3% |
| | Min | 27.7 | 0.5 | 0.48 | 0.8 | 1.9 | 0.7 | 2.4 | 7.07 | 1.29 | 1.07 | 0.91 | 0 | -2.4 | -0.3 | 0 | 35% | 23% | 29% | 0% |
| Fig.13 | Max | 27.7 | 0.32 | 0.41 | 0.8 | 1.33 | 0.5 | 2.25 | 8.24 | 1.24 | 1.06 | 0.91 | 0 | -0.65 | -0.08 | 0 | 36% | 37% | 40% | 5% |
| | Min | 27.7 | 0.5 | 0.42 | 0.78 | 1.33 | 0.5 | 2.25 | 8.07 | 1.29 | 1.05 | 0.9 | 0 | -0.17 | -0.03 | 0 | 18% | 26% | 34% | 0% |
| **For all figures:** | | | | | | | | | | | | | | | | | | | | |
| **Min** | | 18 | 0.18 | 0.31 | 0.77 | 0 | 0.5 | 0 | 4 | 1.12 | 1.03 | 0.84 | | -0.17 | 0 | | 18% | 23% | 29% | 0% |
| **Max** | | 47 | 2 | 0.48 | 0.9 | 1.33 | 3 | 3 | 8.3 | 1.37 | 1.07 | 1.35 | | -3.3 | -1.08 | | 46% | 37% | 40% | 5% |
| **Max/Min** | | 2.611 | 11.111 | 1.548 | 1.169 | >>1 | 6 | >>1 | 2.075 | 1.223 | 1.039 | 1.607 | | 19.4 | >>1 | | 2.475 | 1.643 | 1.389 | >>1 |

ELECTROSTATIC ION MIRRORS

TECHNICAL FIELD

The invention generally relates to the area of mass spectroscopic analysis, electrostatic traps and multi-reflecting time-of-flight mass spectrometers, and to an apparatus, including electrostatic ion mirrors with improved quality of isochronicity and energy tolerance.

BACKGROUND

Electrostatic Analyzers:

Electrostatic ion mirrors may be employed in electrostatic ion traps (E-traps), open electrostatic traps (Open E-traps), and multi-reflecting time-of-flight mass spectrometers (MR-TOF MS). In all three cases, pulsed ion packets experience multiple isochronous reflections between parallel grid-free electrostatic ion mirrors spaced by a field-free region.

MR-TOF:

In MR-TOF, ion packets propagate through the electrostatic analyzer along a fixed flight path from an ion source to a detector, and ions' m/z ratios are calculated from flight times. SU1725289, incorporated herein by reference, introduces a scheme of a folded path MR-TOF MS, using two-dimensional gridless and planar ion mirrors. Ions experience multiple reflections between planar mirrors, while slowly drifting towards the detector in a so-called shift direction. The number of reflections is limited to avoid spatial spreading of ion packets and their overlapping between adjacent reflections. GB2403063 and U.S. Pat. No. 5,017,780, incorporated herein by reference, disclose a set of periodic lenses within planar two-dimensional MR-TOF to confine ion packets along the main zigzag trajectory. The scheme provides fixed ion path and allows using many tens of ion reflections.

In co-pending applications P129429 (E-trap; U.S. patent application Ser. No. 13/522,458, now U.S. Pat. No. 9,082,604), P129992 (open E-trap; U.S. patent application Ser. No. 13/582,535, now published as U.S. Publication No. 2013/0056627), P130653 (MR-TOF; U.S. patent application Ser. No. 13/695,388, now U.S. Pat. No. 8,853,623) and provisional application 61/541,710 (Cylindrical analyzer; now filed as U.S. patent application Ser. No. 14/441,700 and published as WO 2014/074822), incorporated herein by reference, there is disclosed a hollow cylindrical analyzer formed by two sets of coaxial rings having a cylindrical field volume. The analyzer provides an effective folding of ion trajectory per compact analyzer size.

E-Traps:

In E-traps, ions may be trapped indefinitely. An image current detector is employed to sense the frequency of ion oscillations as suggested in U.S. Pat. No. 6,013,913A, U.S. Pat. No. 5,880,466, and U.S. Pat. No. 6,744,042, incorporated herein by reference. Such systems are referred to as Fourier Transform S-traps. To improve the space charge capacity of E-traps, the co-pending application P129429 (now U.S. Pat. No. 9,082,604), incorporated herein by reference, describes extended E-traps employing two-dimensional fields of planar and hollow cylindrical symmetries.

E-Trap MS with a TOF detector resemble features of both MR-TOF and E-traps. Ions are pulse-injected into a trapping electrostatic field and experience repetitive oscillations along the same ion path, so the technique is called I-path E-trap. Ion packets are pulse ejected onto the TOF detector after some delay corresponding to a large number of cycles. In FIG. 5 of GB2080021 and in U.S. Pat. No. 5,017,780, incorporated herein by reference, ion packets are reflected between coaxial gridless mirrors.

The co-pending application P129992 (now published as U.S. Publication No. 2013/0056627), incorporated herein by reference, describes an open E-trap, where ions propagate through an analyzer, but the flight path is not fixed—it may contain an integer number of oscillations within some span before ions reach a detector.

Gridless Ion Mirrors:

To increase resolution of TOF MS, U.S. Pat. No. 4,072,862, incorporated herein by reference, discloses a grid covered dual stage ion mirror which provides second order time per energy focusing. Multiple reflections may be arranged within grid-free ion mirrors to prevent ion losses. U.S. Pat. No. 4,731,532, incorporated herein by reference, discloses ion mirrors with purely retarding fields in which a stronger field is located at the mirror entrance to facilitate spatial ion focusing. As disclosed, the mirrors are capable of reaching either a second order time per energy focusing T|KK=0 or a second order time-spatial focusing T|YY=0, but such are unable to reach both conditions simultaneously. SU1725289, incorporated herein by reference, employs similar ion mirrors. In addition, DE10116536, incorporated herein by reference, proposed gridless ion mirrors with an attracting potential at the mirror entrance which improved time per energy focusing. Paper by Pomozov et al JTP (Russian), 2012, V. 82, #4, incorporated herein by reference, demonstrates reaching third order energy focusing in such mirrors in coaxial symmetry. Paper by M. Yavor et al., Physics Procedia, v.1 N1, (2008) 391-400, incorporated herein by reference, provides details of geometry and potentials for planar mirrors and demonstrates reaching simultaneously: spatial focusing; third order time per energy focusing; and second-order time-spatial focusing with compensation of second order cross-terms. However, to sustain resolving power above 100,000 the energy tolerance is limited to about 7%. This limits the maximal strength of electric field in pulsed ion sources and thus the ability of compensating so-called turn around time. As a result, the flight path and flight time in MR-TOF analyzers have to be longer, which in turn limits duty cycle of MR-TOF.

Thus, the prior ion mirrors reach third order time per energy focusing only. Therefore, there is a need for improving aberration coefficients, isochronicity and energy tolerance of ion mirrors.

SUMMARY

The inventors have realized that a higher order time-per-energy focusing by grid-free ion mirrors results from a smoother field distribution in the retarding field region, which in turn includes sufficient penetration—at least one tenth of electrostatic potentials of surrounding electrodes into vicinity of the ion turning point. By setting such criteria and in simulations the inventors found that the energy tolerance of ion mirrors can be increased up to at least 18% (compared to 8% in prior art mirrors) at resolving power above 100,000 and time-per-energy focusing can be brought to the fourth or even higher-order compensation by using a combination of at least three electrodes with distinct retarding potentials and at least one electrode with accelerating potential (not accounting electrodes of drift region) and by satisfying particular relations between electrode sizes and potentials.

There are provided several particular examples of such high quality ion mirrors with fifth-order time per energy focusing. Most of parameters can be varied, though causing adjustment of other parameters. Multiple graphs illustrate linked variations of several geometrical sizes and electrodes potentials. There is also described a numerical strategy of arriving to an exact combination of ion mirror parameters providing fifth-order time-per-energy focusing. Such strategy allows varying individual parameters, distorting electrode shapes, changing intra-electrode gaps, and introducing additional electrodes while still arriving to parameter combinations providing fifth-order time-per-energy focusing.

The inventors further realized that in ion mirrors with equal height of electrode window H, in order to provide the above described field penetration in the vicinity of ion turning point, the ratios of X-length L2 and L3 of second and third retarding electrodes to H should be limited to $0.2 \le L2/H \le 0.5$ and $0.6 \le L3/H \le 1$, and the ratio of potentials at the first three electrodes to mean ion kinetic energy per charge K/q should be limited as $1.1 \le V1 \le 1.4$; $0.95 \le V2 \le 1.1$; and $0.8 \le V3 \le 1$, and wherein $V1 > V2 > V3$.

The inventors further realized that high isochronicity is the result of sufficient penetration of electrostatic fields from at least three electrodes to provide smooth distribution of electrostatic field with monotonous behavior of potential, electric field and their higher derivatives. This appears to be a (though not sufficient alone) condition for high order isochronicity.

The inventors further realized that the angular and spatial acceptance of ion mirrors can be optimized by varying length of the attracting electrode or by adding a second attracting electrode. The inventors further realized that the fifth-order time per energy focusing may be obtained for hollow cylindrical ion mirrors with minor adjustment of potentials relative to planar ion mirrors.

In an embodiment, there is provided an isochronous electrostatic time-of-flight or ion trap analyzer comprising:

(a) two parallel and aligned grid-free ion mirrors separated by a drift space, wherein the ion mirrors are substantially elongated in one transverse direction to form a two-dimensional electrostatic field, wherein the electrostatic field is of a planar symmetry or of a hollow cylindrical symmetry, and wherein one of said ion mirrors has at least three electrodes with retarding potential;

(b) at least one electrode with an accelerating potential compared to the drift space;

(d) wherein sizes of said at least three electrodes with retarding potential are adjusted to provide potential penetration within a middle electrode window, on optical axis and in a middle region between adjacent electrodes above one tenth of their potential; and (e) wherein for the purpose of improving resolving power of said electrostatic analyzer, shapes, sizes and potentials (collectively, parameters) of the electrodes of the ion mirrors are selectively adjustable and adjusted to provide less than 0.001% variations of flight time within at least 10% energy spread for a pair of ion reflections by the ion mirrors.

In an implementation, the electrodes may have equal height H windows, and the ratio of the length L2 and L3 of second and third electrodes (numbered from reflecting mirror end) to H may be $0.2 \le L2/H \le 0.5$ and $0.6 \le L3/H \le 1$; wherein the ratio of potentials at the first three electrodes to mean ion kinetic energy per charge K/q may be $1.1 \le V1 \le 1.4$; $0.95 \le V2 \le 1.1$; and $0.8 \le V3 \le 1$ and wherein $V1 > V2 > V3$. In an embodiment, the lengths of the second and third electrodes may include half of surrounding gaps with adjacent electrodes. Additionally, the electrodes may comprise one of the group: (i) thick plates with rectangular window or thick rings; (ii) thin apertures; (iii) tilted electrodes or cones; and (iv) rounded plates or rounded rings. In an embodiment, at least some of the electrodes may be electrically interconnected, either directly or via resistive chains. Further, in an embodiment, parameters of the mirror electrodes may be adapted to provide less than 0.001% variations of flight time within at least 18% energy spread. In an implementation, the function of flight time per initial energy may have at least four extremums.

In an embodiment, parameters of said ion mirrors may be adapted to provide at least forth-order time-per-energy focusing with (T|K)=(T|KK)=(T|KKK)=(T|KKKK)=0, or even (T|KKKKK)=0. Further, parameters of said ion mirrors may be adapted to provide the following conditions after a pair of ion reflections in ion mirrors: (i) spatial and chromatic ion focusing with (Y|B)=(Y|K)=0; (Y|BB)=(Y|BK)=(Y|KK)=0 and (B|Y)=(B|K)=0; (B|YY)=(B|YK)=(B|KK)=0; (ii) First order time of-flight focusing with (T|Y)=(T|B)=(T|K)=0; and (iii) Second order time-of-flight focusing, including cross terms with (T|BB)=(T|BK)=(T|KK)=(T|YY)=(T|YK)=(T|YB)=0; all being expressed with the Taylor expansion coefficients.

In an implementation, parameters of the mirror electrodes may be those shown in FIGS. 3 to 18. As described herein, the axial electrostatic field within said ion mirror may be the one corresponding to ion mirrors shown in FIGS. 3 to 15. Additionally, a shape of electrodes may correspond to equi-potential lines of ion mirrors shown in FIGS. 3 to 18. In an embodiment, the mirror electrodes may be linearly extended in the Z-direction to form two-dimensional planar electrostatic fields. As depicted, each of said mirror electrodes may comprise two coaxial ring electrodes forming a cylindrical field volume between said rings, and wherein potentials on such electrodes are adjusted compared to planar electrodes of the same length as described in FIG. 7. To reduce time-spatial aberrations, the apparatus may further comprise an additional electrode with an attractive potential as shown in FIG. 6. In an implementation, the at least one electrode with an attracting potential may be separated from said at least three electrodes with retarding potential by an electrode with potential of drift region for a sufficient length such that electrostatic fields of the retarding and accelerating portions of the analyzer are decoupled.

In an embodiment, there is provided a method of mass spectrometric analysis in isochronous multi-reflecting electrostatic fields comprising the following steps:

(a) forming two regions of electrostatic fields between ion mirrors that are separated by field-free space, wherein the ion mirror field is substantially two-dimensional and extended in one direction to have either planar symmetry or a hollow cylindrical symmetry;

(b) forming at least one region with an accelerating field;

(c) within at least one ion mirror field, forming a retarding field region with at least three electrodes at a reflecting end;

(d) forming a retarding field region with at least three electrodes at a reflecting end, wherein the three electrodes include retarding potentials such that at the turning point of ions, the mean kinetic energy provides potential penetration above 10%; and (e) adjusting an axial distribution of the ion mirror field to provide less than 0.001% variations of flight time within at least 10% energy spread for a pair of ion reflections by said mirror fields.

In an implementation, the step of forming the retarding field may comprise a step of choosing electrode shape such that at the turning point of ions, the mean kinetic energy provides potential penetration above 17%. In an implementation, the retarding field may be adjusted to provide comparable penetration of potential from at least two electrodes at a turning point of ions with mean kinetic energy.

In an embodiment, the retarding region of said at least one electrostatic ion mirror field may correspond to a field formed with electrodes having lengths L2 and L3 of second and third electrodes (numbered from reflecting mirror end) to electrode window height H are $0.2 \leq L2/H \leq 0.5$ and $0.6 \leq L3/H \leq 1$; wherein the ratio of potentials at the first three electrodes to mean ion kinetic energy per charge K/q are $1.1 \leq V1 \leq 1.4$; $0.95 \leq V2 \leq 1.1$; and $0.8 \leq V3 \leq 1$, and wherein $V1 > V2 > V3$. In an implementation, the structure of the at least one mirror field may be adapted to provide less than 0.001% variations of flight time within at least 18% energy spread. Additionally, the structure of the at least one mirror field may be adapted such that that the function of flight time per initial energy has at least four extremums.

The structure of the at least one mirror field may be adjusted such that after a pair of ion reflections in ion mirrors to provide at least forth-order time-per-energy focusing with (T|K)=(T|KK)=(T|KKK)=(T|KKKK)=0, or even further (T|KKKKK)=0, or even further provide the following conditions: (i) spatial and chromatic ion focusing with (Y|B)=(Y|K)=0; (Y|BB)=(Y|BK)=(Y|KK)=0 and (B|Y)=(B|K)=0; (B|YY)=(B|YK)=(B|KK)=0; (ii) First order time of-flight focusing with (T|Y)=(T|B)=(T|K)=0; and (iii) Second order time-of-flight focusing, including cross terms with (T|BB)=(T|BK)=(T|KK)=(T|YY)=(T|YK)=(T|YB)=0; all being expressed with the Taylor expansion coefficients.

In an embodiment, the at least one electrostatic ion mirror field or axial distribution of the field may correspond to those formed with electrodes shown in FIGS. 3 to 18. Additionally, the method may further comprise a step of time-of-flight or ion trap mass spectrometric analysis.

BRIEF DESCRIPTION OF THE DRAWINGS

Various embodiments of the present invention together with arrangement given illustrative purposes only will now be described, by way of example only, and with reference to the accompanying drawings in which:

FIG. 1 presents prior art TOF MS analyzer with grid-free ion mirrors having third-order time per energy focusing and shows the view of electrode geometry and electrode parameters (1A); a table of aberration coefficients and magnitudes (1B); a list of compensated aberration coefficients (1C); a graph of a normalized flight time per energy (1D); view of equi-potential lines and an exemplar trajectory (1E); and axial distributions of potential and field strength (1F);

FIG. 3 presents an embodiment of electrostatic multi-reflecting analyzer with the fifth-order time-per-energy focusing of present invention, and shows the view of electrode geometry and electrode parameters (3A); a table of aberration coefficients and magnitudes (3B); a list of compensated aberration coefficients (3C); a graph of a normalized flight time per energy (3D); view of lines of equal potential and exemplar trajectory (3E); and axial distributions of potential and field strength (3F);

FIG. 5 presents an embodiment of ion mirror with increased intra-electrode gaps (5A) and compares parameters and aberration coefficients versus gap size (5B);

FIG. 6 presents an embodiment of ion mirror with six electrodes (6A) and compares aberration coefficients for ion mirrors with five and six electrodes (6B);

FIG. 7 compares planar and hollow-cylindrical ion mirrors with the fifth-order time-per-energy focusing;

FIG. 8 shows a range of variations of electrode potentials for ion mirror of FIG. 3 (five electrodes) in order to maintaining resolving power above 100,000;

FIG. 9 shows variation of ion mirror parameters at an enforced variation of fourth electrode length for ion mirror of FIG. 3 (five electrodes mirror);

FIG. 10 shows variation of ion mirror parameters at an enforced variation of fifth electrode length for ion mirror of FIG. 3 (five electrodes mirror);

FIG. 11 shows variation of ion mirror parameters at an enforced variation of the first electrode length for ion mirror of FIG. 6 (six electrodes mirror);

FIG. 12 shows variation of ion mirror parameters at an enforced variation of the fourth electrode length L4/H for ion mirror of FIG. 6 (six electrodes mirror);

FIG. 13 shows variation of ion mirror parameters at an enforced variation of the fifth electrode length L5/H for ion mirror of FIG. 6 (six electrodes mirror);

FIG. 14 shows variation of ion mirror parameters at an enforced variation of the Lcc/H (relative analyzer length per analyzer height) for ion mirror of FIG. 6 (six electrodes mirror);

DETAILED DESCRIPTION

Definitions and Notations

Figure 2:
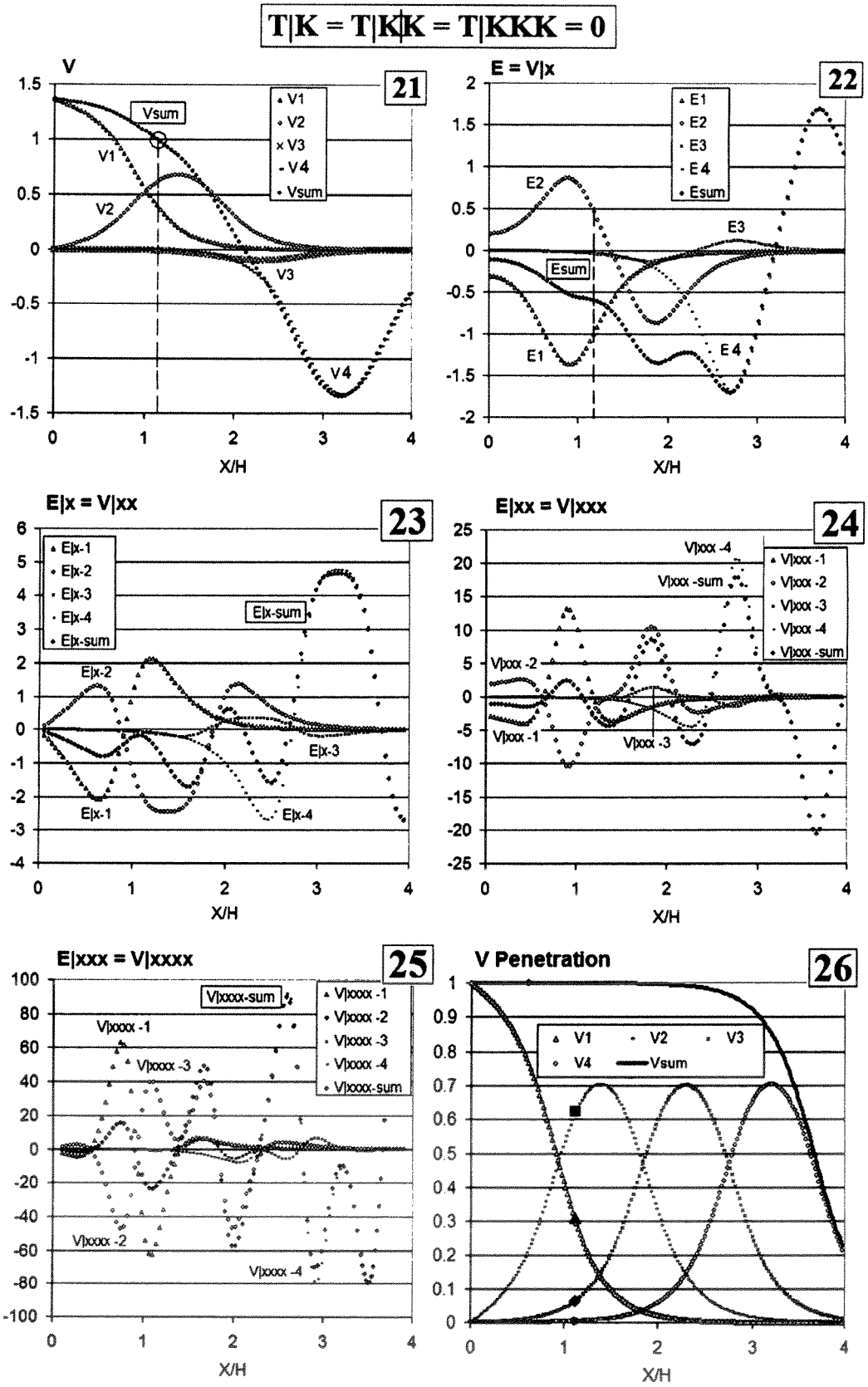
FIG. 2 shows plots for input of individual electrodes into a normalized axial potential distribution and its derivatives for prior art ion mirror of FIG. 1.

All of the considered isochronous electrostatic analyzers are characterized by two dimensional electrostatic fields in an XY-plane: X corresponds to the time separating axis (e.g. to direction of ion reflection by ion mirrors); Y corresponds to the second direction of the two-dimensional electrostatic field; Z corresponds to the orthogonal drift direction (i.e., to the direction of substantial extension of ion mirror electrodes); Y and Z are also referred as transverse directions; A corresponds to an inclination angle to the X-axis in an XZ-plane; and B corresponds to an elevation angle to the Y-axis in an XY-plane. The definition stands for both considered cases of electrostatic analyzers: the first one is composed of plates extended in the Z-direction and forms a planar two-dimensional field; the second one is composed of two sets of coaxial rings and forms a cylindrical field gap with two-dimensional field of cylindrical symmetry.

Ion packets can be characterized by: mean energy K and energy spread ΔK in X-direction; angular divergences ΔA and ΔB in Y and Z-directions; spatial-angular divergences $D_Y = \Delta Y * \Delta B$ and $D_Z = \Delta Z * \Delta A$ in Y and Z-directions; and $\Phi = \Delta Y * \Delta B * \Delta Z * \Delta A * K$–phase-space volume of ion packets. The phase-space volume of ion packets Φ generated in ion source is called 'emittance'. Phase-space of ion packets is conserved within electrostatic fields of multi-reflecting analyzers. The maximal phase space which can be passed through the analyzer is called analyzer acceptance.

Resolving power of TOF analyzers is calculated as $R=T_0/2\Delta T$, where $T_0$ is mean flight time and $\Delta T$ is the time spread of ion packets on a detector. Energy tolerance of the analyzer $(\Delta K/K)_{MAX}$ is defined as relative energy spread which allows obtaining the target resolving power, here 100,000. Even in the ideal electrostatic analyzer with zero aberrations, the resolving power is limited by the initial time-energy spread of ion packets $\Delta K*\Delta T_0$, where $\Delta K$ is the energy spread in X-direction and $\Delta T_0$ is the time spread from the ion source. The time-energy spread is proportional to $D_X=\Delta V*\Delta X$ and is conserved in pulse accelerating sources relative to the strength E of accelerating field. While initial time spread is primarily defined by velocity spread $\Delta V$ in X direction $\Delta T_0=\Delta Vm/Eq$ (turn-around time), the energy spread $\Delta K=\Delta X*E$ is primarily defined by initial spatial spread $\Delta X$.

Depending on the ion packet emittance MR-TOF analyzers induce spatial and time spreads (aberrations) on the detector. Analyzers with high resolving power should have relatively small aberrations expressed via a Taylor expansion with aberration coefficients (*|*), for example:

$$T(X,Y,A,B,K)=T_0+(T|Y)*Y+(T|B)*B+(T|K)*K+(T|YY)*Y^2+(T|YB)*Y*B+(T|BB)*B^2+(T|YK)*YK+(T|BK)*BK+(T|KK)*K^2+\ldots.$$

While accurate calculation of time spread should account for the exact initial phase-space distribution of ion packets and the calculation of peak shape, an estimate of the time spread on detector $\Delta T$ can be made by summing individual dispersions:

$$\Delta T^2=[(T|Y)*\Delta Y]^2+[(T|B)*\Delta B]^2+[(T|K)*K]^2+\ldots.$$

Compensation of higher order aberration coefficients is the merit of ion optical scheme which improves acceptance and energy tolerance of the analyzer at a desired level of resolving power.

Ion mirror's lengths of electrodes $L_i$, cap-to-cap distance $L_{cc}$, and intra-electrode gaps $H_i$ are normalized to electrode window height $H-L_i/H$, $G_i/H$ and $L_{cc}/H$; electrode voltages $U_i$ are normalized to mean kinetic energy per ion charge $V_i=U_i/(K/q)$.

PRIOR ART

Referring to FIG. 1-A, an exemplary prior art multi-reflecting analyzer 11 is shown having two identical planar ion mirrors 12 separated by a drift space 13. The analyzer 11 provides a third-order time-per-energy focusing. Each mirror comprises four (4) electrodes. The electrodes have windows with equal height H in the Y-direction, equal length L1 to L4 in the X-direction such that L/H=0.9167, and equal and negligibly small gaps G between electrodes in X-direction such that G/H<<1. It has been demonstrated in prior art that the gaps could be increased to 0.1*H without degrading the analyzer performance. Ion mirror dimensions and normalized potentials on electrodes V1 to V4 (collectively, mirror parameters) are shown in FIG. 1A. In the particular example, H=30 mm, Li=27.5 mm, and $L_{cc}$=610 mm and K/q=4500V. Potentials in the third line correspond to exact compensation of the first three time-per-energy aberration coefficients T|K=T|KK=T|KKK=0. Note that for convenience of grounding ion sources, usually the entire analyzer is floated, such that the drift region is at an accelerating potential. In such case actual V-values are lower by −1.

TABLE 1

Aberration coefficients and magnitudes of prior art TOF analyzer in FIG. 1A with third order time-per-energy focusing after two ion mirror reflections.

| Aberrations (normalized by TOF) | Mirror with $3^{rd}$ order focusing | |
|---|---|---|
| | Coefficient | Magnitude $\times 10^6$ |
| (T\|YYK) | 0.07242 | 16.97 |
| (T\|BBK) | 6.384 | 3.448 |
| (T\|YYKK) | −0.4595 | −6.462 |
| (T\|BBKK) | −85.51 | −2.770 |
| (T\|KKKK) | 11.44 | 148.2 |
| (T\|YYKKK) | −14.19 | −11.97 |
| (T\|BBKKK) | −560.8 | −1.090 |
| (T\|KKKKK) | 8.452 | 65.75 |
| (T\|KKKKKK) | −114.7 | −5.350 |

Referring to FIG. 1B, the analyzer has the following non-negligible aberration coefficients (with magnitudes above $10^6$) also shown in the Table 1. Magnitudes are expressed in flight time deviations $\Delta T$ being normalized to mean flight time $T_0$, at Y/H=0.05 (ion beam's half height Y=1.5 mm at widow height H=30 mm), half angle B=3 mrad and relative half energy spread $\Delta K/K$=6% and for cap-to-cap distance Lcc/H=20.32.

Referring to FIG. 1C, and as can be seen from Table 1, the prior art mirror provides the following focusing properties after a pair of mirror reflections:

Spatial and Chromatic Focusing:

$$(Y|B)=(Y|K)=0;\ (Y|BB)=(Y|BK)=(Y|KK)=0;$$

$$(B|Y)=(B|K)=0;\ (B|YY)=(B|YK)=(B|KK)=0;$$

First Order Time of-Flight Focusing $$(T|Y)=(T|B)=(T|K)=0;$$

Second Order Time-of-Flight Focusing, Including Cross Terms $$(T|BB)=(T|BK)=(T|KK)=(T|YY)=(T|YK)=(T|YB)=0;$$

And Third Order Time-Per-Energy Focusing:

$$(T|K)=(T|KK)=(T|KKK)=0$$

The higher order time-per-energy aberration coefficients: $(T|KKKK)/T_0=11.438$; $(T|KKKKK)/T_0=8.452$; and $(T|KKKKKK)/T_0=-114.671$. They are responsible for significant magnitudes of time-of-flight spread, and are capable of generating long tails in TOF peaks at half energy spreads above 4%.

Referring to FIG. 1D, a graph of flight time-per-energy for the analyzer of FIG. 1A has a characteristic shape of a fourth-order polynomial. At (T|K)=(T|KK)=(T|KKK)=0 the curve is shown by a dashed curve. The flight time variations stay within 0.005% (R=100,000) for up to 6% full energy spread. A wider energy tolerance can be achieved by tuning mirror voltages such that there appears small second derivative at (T|K)=(T|KKK)=0 and (T|KK)/T0=−0.0142 which is shown by dotted curve. Then, the energy acceptance improves to 8% full energy spread at R=100,000. The range of energy focusing stills limit the ability of forming short ion packets in the ion source and, in particular, of reducing so-called turn around time.

Referring to FIG. 1E, there are shown lines of equal potential and also exemplar ion trajectory. Electrodes could be made curved with the shape of equi-potential lines, while still preserving the same field distribution. The exemplar trajectory shows the type of spatial focusing—ions starting off the axis and parallel to the axis get reflected at the mirror axis and returns to the central point at some angle. After second mirror reflection, the trajectory returns to the same amplitude of vertical Y displacement at zero angle. Because of non-linear effects, vertical confinement stays reproducible for indefinite number of reflections.

Referring to FIG. 1F, the axial distributions are shown for a normalized potential and field strength. The field has two pronounced regions—(a) lens region which is responsible for spatial ion focusing and for reduction of time per energy derivatives in the field-free region, and (b) a reflecting region with gradually variable field, wherein field derivatives are linked to time-per-energy derivatives in the reflector.

We claim that the prior art ion mirrors do not have sufficient penetration of electrostatic field from adjacent electrodes. This in turn limits the ability of forming proper field in the reflecting region such that to compensate higher order time-of-flight aberrations. To examine the field let us analyze field structure using analytical expressions for ion mirror fields.

Field Analysis

An axial distribution of electrostatic potential in the ion mirror with a cap, equal height of electrodes H, and with negligible intra-electrode gaps can be calculated as:

$$V(x) = \frac{4V_i}{\pi}\arctan\left[\exp\left(-\frac{\pi x}{H}\right)\right] + \sum_{i=1}^{n}\frac{2V_i}{\pi}\left\{\arctan\left[\exp\left(\frac{\pi(x-a_i)}{H}\right)\right] + \arctan\left[\exp\left(\frac{\pi(x+a_i)}{H}\right)\right]\right\} - \sum_{i=1}^{n}\frac{2V_i}{\pi}\left\{\arctan\left[\exp\left(\frac{\pi(x-b_i)}{H}\right)\right] + \arctan\left[\exp\left(\frac{\pi(x+b_i)}{H}\right)\right]\right\} \quad [1]$$

Where V(x) is axial distribution of potential normalized to q/K and $V_i$—is the normalized to q/K potentials of i-th electrode, counting from the cap electrode, x—is coordinate measured from the cap electrode, $a_i$ and $b_i$ are X-coordinates of left and right edges of i-th electrode, H—is the height of electrode windows. The analytical distribution also allows simulating normalized (to x/H) electric field strength E=V|X, and up to at least $4^{th}$ order derivatives V|xx, V|xxx, and V|xxxx. Note, that by setting all Vi to zero except one, it becomes possible calculating an electrostatic field which is induced by an individual electrode, so as the derivatives of this field.

Referring to FIG. 2, for the prior art ion mirror of FIG. 1A there is plotted axial distributions 21 to 25 of $V_i$ and total V(x) called $V_{sum}$, so as their derivatives up to the fourth order $V_i$|xxxx. One can see that the ion turning point with $V_{sum}$=1, corresponding to reflection of ions with mean kinetic energy K, is located within the second electrode and at X/H=1.12. The right bottom graph 26 shows the degree of field penetration from electrodes, where each curve corresponds to all $V_i$=0 except one $V_j$=1. The field in the vicinity of reflecting point $X=X_T$=1.12*H can be affected mostly by first and second electrodes having $V_1(X_T)/V_1$=0.294 and $V_2(X_T)/V_2$=0.63. Other electrodes have very weak field penetration: $V_3(X_T)/V_3$=0.067 and $V_4(X_T)/V_4$=0.004. Because of limited flexibility in the field adjustment, the higher order derivatives V|KK, V|KKK and V|KKKK have non monotonous behavior, which is expected to affect performance of the electrostatic analyzer by inducing high order time-of-flight aberrations T|KKKK and T|KKKKK, so as high-order cross aberrations.

Improvement Strategy

In order to smooth higher order spatial derivatives of electrostatic field in the reflecting section of ion mirror, we propose using thinner electrodes such that to increase penetration of their electrostatic field in the vicinity of reflecting point. We propose using at least four electrodes with the degree of potential penetration of at least 0.2 and wherein the reflecting potential at the field axis is situated within one of inner electrodes. In search of exact combination of such fields, and in order to improve energy tolerance of ion mirrors, we explored a wide class of ion mirror geometries with denser electrode configuration in the reflecting region. As a result, we found multiple examples to form a novel class of ion mirrors and simultaneously provide a combination of: (a) spatial focusing properties; (b) second order time-of-flight focusing; and (c) a higher order time-per-energy focusing with compensation of fourth and fifth coefficients of the Taylor expansion.

The search strategy included the following steps:

9. assuming an ion mirror with electrodes having the same vertical window H and with zero gaps between adjacent electrodes. With the foregoing, an electrostatic field in such mirror can be calculated with exact analytical expression [1] derived on conformal mapping theory and assuming a symmetric reflection of the mirror geometry around the mirror cap;
10. setting at least three electrodes with retarding potential and one with accelerating potential, retarding electrodes being optionally separated from the accelerating one by a zero potential electrode, and a free-flight electrode with zero potential;
11. forcing several relations, in particular 0.2<L2/H<0.5, 0.6<L3/H<1, V1>$V_t$, V2>$V_t$ and V3<$V_t$; and letting other parameters be adjusted;
12. calculating aberration coefficients by integrating the coefficients along the central ion path for a pair of reflections between identical ion mirrors;
13. setting a goal criterion for a combination of the aberration coefficients (as an example, such a criterion may be expressed as follows: $10((Y|Y)+1)^2+0.01(T|BB)^2+(T|D)^2+0.1(T|DD)^2+0.01(T|DDD)^2+0.001(T|DDDD)^2+0.0001(T|DDDDD)^2<10^{-10}$);
14. setting initial conditions for electrode potentials and lengths and letting an optimization procedure to adjust them. In order to force convergence of the process to a desired goal criterion with realistic values of adjusted parameters, correcting the optimization process manually by varying some initial parameter values or setting additional limitations on a particular parameter. This particular stage took the inventors years to find ion mirror parameters satisfying high order isochronicity.
15. after finding at least one set of parameters corresponding to high quality of ion mirror, making small step adjustments on individual mirror parameters for finding realistically optimal combination of magnitudes of aberrations not included into the goal criterion.
16. for varying electrodes shapes, setting these shapes fixed during optimization and letting the automatic procedure optimizing voltages to reach the best approximation of the optimization criterion. Manually adjusting the shapes to approach the goal values of the optimization criterion.

Let us stress the fact that an automatic optimization of steps 7 and 8 became possible after the inventors have found proper relations of step 3 and proper set of initial values of electrode potentials and lengths in step number 6.

Reference Ion Mirror with Fifth-Order Focusing

Referring to FIG. 3A, an embodiment of electrostatic analyzer 31 comprises two identical planar ion mirrors 32 separated by a drift space 33. The geometry is characterized by cap-to-cap distance Lcc, length of drift region Ld, equal height H of electrode windows, lengths of individual electrodes L1 to L5 and by normalized voltages V1 to V5 where Vi=Ui/(K/q), Ui are actual voltages, K-mean ion energy, and q-is ion charge. Parameters of ion mirrors are shown in the Table of FIG. 3A. Parameters may be slightly different for two cases of complete compensation of aberration coefficients and for optimal tuning of the analyzer to reach highest possible energy tolerance. Note that an additional fourth electrode is added, which has potential of the drift (i.e. field-free) region. Such electrode allows decoupling electrostatic fields of reflecting and of accelerating portions of ion mirrors. The electrode is added primarily for convenience of the analysis and as shown in the below text a highly isochronous mirror could be formed without this additional electrode. Also note that for convenience of grounding ion sources, usually the entire analyzer is floated, such that drift region occurs at accelerating potential. In such case actual V values are lower by −1.

Referring to FIG. 3B and to the below Table 2, the analyzer reaches the following aberration coefficients and aberration magnitudes after a pair of ion reflections in ion mirrors 32. The analyzer compensates T|KKKK and T|KKKKK aberrations and substantially reduces most of third- and fifth-order cross terms, though at a cost of twice higher T|BBK aberration, i.e. the fifth-order analyzer is better suited for narrower ion packets. Magnitudes are expressed in relative flight time deviations $\Delta T/T_0$, at Y/H=0.0625 (ion beam's half height Y=1.5 mm at widow height H=24 mm), half angle B=3 mrad, relative half energy spread ΔK/K=6%, and for Lcc/H=25.5.

TABLE 2

Aberration coefficients and magnitudes of the analyzer 31 in FIG. 3A with the fifth-order time-per-energy focusing compared to those in prior art TOF analyzer 11 in FIG. 1A with the third-order time-per-energy focusing.

| Aberrations | Mirror with $3^{rd}$ order energy focusing | | Mirror with $5^{th}$ order energy focusing | |
|---|---|---|---|---|
| (normalized by TOF) | Aberration Coefficient | Magnitude $\times 10^6$ | Aberration Coefficient | Magnitude $\times 10^6$ |
| (T\|YYK) | 0.07242 | 16.97 | 0.05536 | 12.97 |
| (T\|BBK) | 6.384 | 3.448 | 12.90 | 6.965 |
| (T\|YYKK) | −0.4595 | −6.462 | 0.09198 | 1.293 |
| (T\|BBKK) | −85.51 | −2.770 | −68.13 | −2.207 |
| (T\|KKKK) | 11.44 | 148.2 | | |
| (T\|YYKKK) | −14.19 | −11.97 | −2.170 | −1.832 |
| (T\|BBKKK) | −560.8 | −1.090 | | |
| (T\|KKKKK) | 8.452 | 65.75 | | |
| (T\|KKKKKK) | −114.7 | −5.350 | 142.5 | 6.648 |

Referring to the above Table 2 and to FIG. 3C, the ion mirror of the invention reaches the following types of ion focusing after a pair of ion reflections by mirrors:

Spatial and Chromatic Focusing:

$$(Y|B)=(Y|K)=0;\ (Y|BB)=(Y|BK)=(Y|KK)=0;$$

$$(B|Y)=(B|K)=0;\ (B|YY)=(B|YK)=(B|KK)=0;$$

First Order Time-of-Flight Focusing $$(T|Y)=(T|B)=(T|K)=0;$$

Second Order Time-of-Flight Focusing, Including Cross Terms $$(T|BB)=(T|BK)=(T|KK)=(T|YY)=(T|YK)=(T|YB)=0;$$

And the Fifth-Order Time-Per-Energy Focusing:

$$(T|K)=(T|KK)=(T|KKK)=(T|KKKK)=(T|KKKKK)=0$$

Note, that because of positive T|BBK and T|YYK in the best tuning point, it is worth leaving a slight negative T|K for a better mutual compensation.

FIG. 3D shows a graph of time-per-energy for the analyzer 31 in FIG. 3A. The energy acceptance which corresponds to resolving power R=100,000 is increased to 11% of full energy spread at complete compensation of time-per-energy aberrations (T|K)=(T|KK)=(T|KKK)=0; (T|KKKK)=0; (T|KKKKK)=0; and the energy acceptance further increases to 18% at (T|K)=(T|KKK)=(T|KKKKK)=0; $(T|KK)/T_0=0.00525$; and $(T|KKKK)/T_0=-1.727$.

The significant improvement of the energy acceptance allows forming much shorter ion packets. For a given phase space of ion cloud ΔX*ΔV prior to extraction, a much higher pulsed electric fields E can be applied thus forming ion packets with shorter turn-around times $\Delta T_0=\Delta V*m/Eq$ while still fitting energy acceptance of the electrostatic analyzers.

FIG. 3E shows lines of equal potentials (equi-potentials), simulated with SIMION program. One could repeat the structure of the described electrostatic field by setting a curved electrode with a shape and potential of those lines. Such electrodes would have different relation between electrode length $L_i$ and electrode window $H_i$. Nevertheless, the field still corresponds to the field formed by rectangular electrodes having the same window height.

FIG. 3F shows axial distributions of potential and electric field strength. The axial distribution defines a two-dimensional distribution of electrostatic field in the vicinity of the X-axis. One could reproduce the axial distribution with electrodes having arbitrary shapes, but still, it would remain similar field distribution which has been first generated with rectangular electrodes having the same window height H and a range of electrode lengths (discussed below). While potential distribution around $5^{th}$ electrode is defined by spatial focusing properties (as shown in FIG. 3E), the potential distribution in the retarding region can be found when optimizing the analyzer for high order energy focusing—the subject discussed below.

Figure 4A:
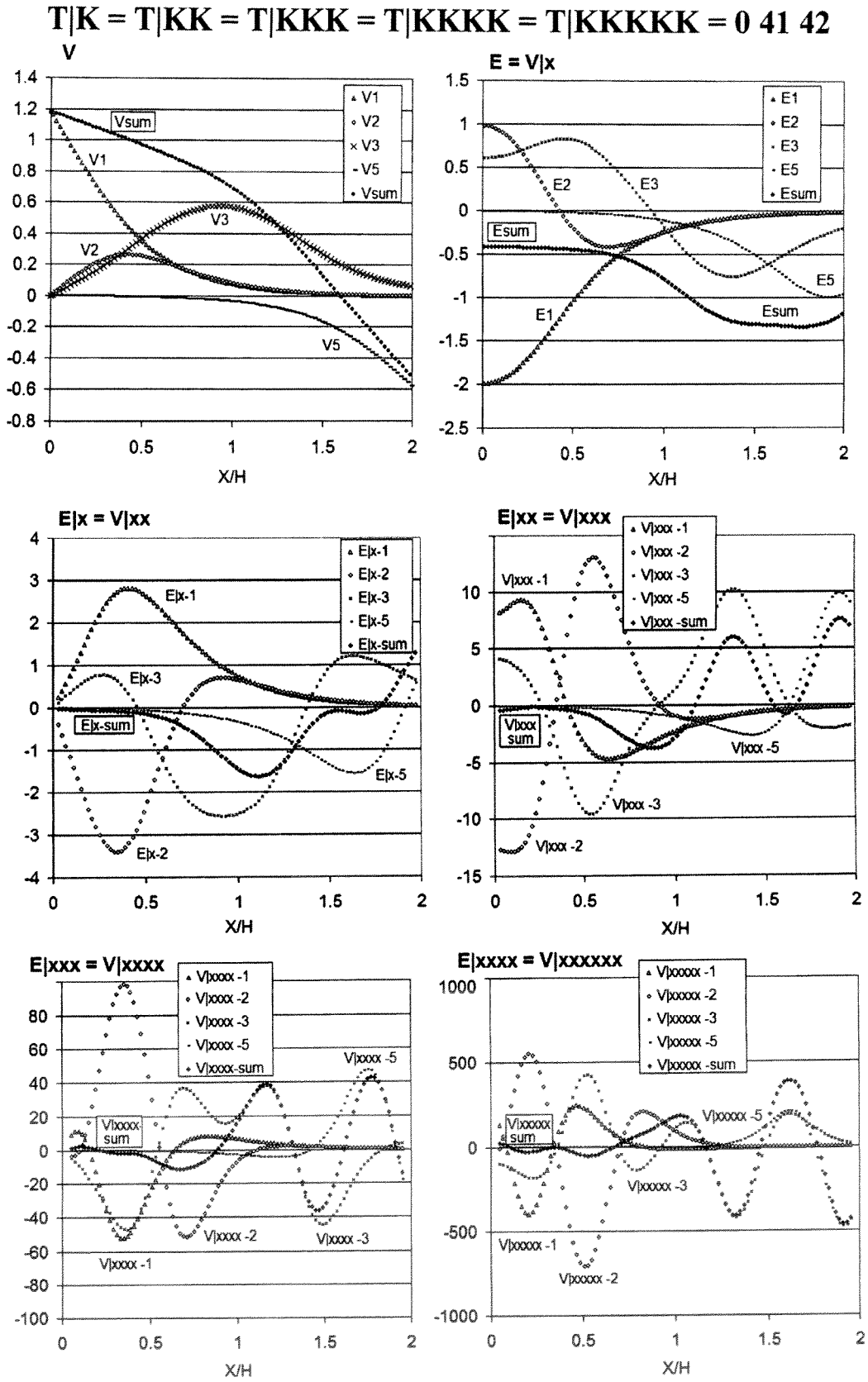
FIG. 4 shows plots for input of individual electrodes into a normalized axial potential distribution and its derivatives for ion mirror of FIG. 3.

Referring to FIG. 4A, for the ion mirror of FIG. 3A there is plotted Vi and Vsum Vs x/H, so as their derivatives up to the fifth-order Vi|xxxxx. One can see that the reflecting point at potential equal to mean ion energy $V_{sum}=1$ corresponds to $X_T=0.43H$. The potential distribution around the turning point corresponds to nearly uniform field strength at normalized E~−0.5 with fairly small negative E|X derivative. Higher order spatial derivatives are well compensated, which becomes possible at sufficient penetration of electrostatic field from surrounding electrodes.

Referring to FIG. 4B, the degree of field penetration is calculated when setting $V_i=1$ while keeping others $V_i=0$. In this particular example, the degree of potential penetration is $V_1(X_T)/V_1=0.36$; $V_2(X_T)/V_2=0.36$; $V_3(X_T)/V_3=0.25$; $V_4(X_T)/V_4=0.03$. Thus the desired electrostatic field is formed with at least three potentials penetrating at least by a quarter into the region of the turning point. When analyzing penetration of electrostatic field, the field of second electrode is about zero at $X=X_T$ since the turning point is within the second electrode. The field penetration $E_1(X_T)=-1.08$ and $E_3(X_T)=0.93$ and $E_4(X_T)=0.1$. Compared to a prior art ion mirror, the field and potential penetration is much larger which allowed forming a smoother field with highly compensated higher order spatial derivatives.

Wider Class of Fifth-Order Focusing Ion Mirrors

In order to explore a wider range of the geometries (which could be formed with rectangular electrodes with equal window heights H), there are presented results of multiple simulations with enforced variations of particular electrode parameters. Once there is found a single example of electrostatic analyzer with fifth-order focusing, multiple variations become possible by modifying mirror geometry in small steps and finding next optimal analyzers with the above described optimization procedure.

Referring to FIG. 5A, in one embodiment 52, the gaps $G_i$ between electrodes were increased and became longer than the length of second electrode L2, without degrading analyzer performance. The second mirror electrode could be referred as an aperture. The geometry is compared to the reference mirror geometry 32 with negligibly small gaps. Mirror 52 has been obtained with a smooth evolution of the mirror 32, with the maintenance of similar distribution of the axial electrostatic field and while keeping high order isochronicity. At such evolution electrode's centers remained at approximately similar but slightly varied positions. The excessively wide gaps may be harmful because of fringing fields (e.g. from surrounding vacuum chamber or from electric wires). On the other hand, small gaps with E<3 kV/mm are necessary to insulate electrodes without breakdown. To improve mirror stability against breakdown one should round sharp edges. However, in all and multiple simulated cases, at moderate gap size $G_i/H<0.1$, and edge curvature $r/H<0.05$ the effective length of electrode $L_i+(G_{i-1}+G_i)/2$ remains almost equal to Li of ion mirrors with negligible gaps. Gap variations require minor adjustment of electrode potentials. For this reason we'll continue analyzing ion mirrors with negligible gap sizes, just because such analysis could be made with analytically expressed electrostatic fields.

Referring to FIG. 6A, in another embodiment of ion mirror 62 for electrostatic isochronous analyzer, a sixth electrode is added. As depicted, the electrode has an attracting potential and could be referred as a second "lens" electrode.

Referring to FIG. 6B, the below Table.3 compare aberration coefficients and magnitudes of the reference ion mirror 32 (five electrodes) and of the mirror 62 (six electrodes). Addition of electrode #6 helps reducing most of aberrations at a cost of higher T|KKKKKK aberration. Such mirror can be useful when dealing with wider diverging ion packets, though having smaller energy spread. Magnitudes are expressed in relative flight time deviations ΔT/T0, at Y/H=0.0625 (ion beam's half height Y=1.5 mm at widow height H=24 mm), half angle B=3 mrad, relative half energy spread ΔK/K=6%, Lcc/H=25.5 for mirror with one accelerating potential, and Lcc/H=27.7 for mirror with two accelerating potentials.

TABLE 3

Aberration coefficients and magnitudes of the analyzer 31 with ion mirrors 32 and with ion mirrors 62, both having fifth-order time-per-energy focusing, but differing by number of mirror electrodes. The table presents aberrations with magnitudes exceeding $10^{-6}$.

| Aberrations | Mirror with 5 order focusing (1 negative potential) | | Mirror with 5 order focusing (2 negative potentials) | |
|---|---|---|---|---|
| (normalized by TOF) | Aberration Coefficient | Magnitude $\times 10^6$ | Aberration Coefficient | Magnitude $\times 10^6$ |
| (T\|YYK) | 0.05536 | 12.97 | 0.03457 | 8.102 |
| (T\|BBK) | 12.90 | 6.965 | 9.490 | 5.124 |

TABLE 3-continued

Aberration coefficients and magnitudes of the analyzer 31 with ion mirrors 32 and with ion mirrors 62, both having fifth-order time-per-energy focusing, but differing by number of mirror electrodes. The table presents aberrations with magnitudes exceeding $10^{-6}$.

| Aberrations | Mirror with 5 order focusing (1 negative potential) | | Mirror with 5 order focusing (2 negative potentials) | |
|---|---|---|---|---|
| (normalized by TOF) | Aberration Coefficient | Magnitude $\times 10^6$ | Aberration Coefficient | Magnitude $\times 10^6$ |
| (T\|YYKK) | 0.09198 | 1.293 | 0.1366 | 1.921 |
| (T\|BBKK) | −68.13 | −2.207 | −37.95 | −1.230 |
| (T\|KKKK) | | | | |
| (T\|YYKKK) | −2.170 | −1.832 | −1.430 | −1.207 |
| (T\|BBKKK) | | | | |
| (T\|KKKKK) | | | | |
| (T\|KKKKKK) | 142.5 | 6.648 | 354.3 | 16.53 |

Note that other electrodes could be added for convenience. As an example an electrode can be inserted between Electrodes #3 and #4 for a more reliable insulation or for mechanical assembly reasons. The inserted electrode may, for example, have either potential of the drift region (this way avoiding extra power supply) or at ground potential.

Referring to FIG. 7, an embodiment of isochronous electrostatic analyzer 71 with hollow cylindrical geometry of ion mirrors 72 is shown. The electrode geometry of mirrors 72 is an exact copy of the planar reference ion mirrors 32, except the mirror is wrapped into a cylinder with central radius R such that to form a hollow cylinder filled with electrostatic field. The graph in the middle shows flight time variations $\Delta T/T_0$ Vs relative energy ΔK/K. Within 10% of full energy spread the $\Delta T/T_0$ stays within 1 ppm. The table at the bottom shows how the mirror potentials have to be adjusted to reach high order energy focusing as a function of R/H ratio. Even at fairly small radius R/H~4 of the hollow torroidal geometry the electrodes' geometry and voltages could be copied from the planar ion mirror while minor adjustment of voltages may take fraction of a volt at 8 kV acceleration. Thus, all the results and conclusions could be analyzed for planar geometry only and could be directly transferred onto cylindrical analyzers with R/H>4.

Referring to FIG. 8, at any fixed geometry there are possible moderate deviations of mirror potentials. For the reference ion mirror 32 at K/q=4500V the allowed variations are: for U1 and U2 for fraction of a Volt (FIG. 8A) and for other electrodes—for tens of Volts without degrading resolution at a level above 100,000 (FIG. 8B). Referring to FIG. 8C, with linked variations of just potentials the region of voltage variation extends. The table presents derivatives of time-per-energy aberration coefficients per individual normalized voltages V1, V2 and V3, so as per electrode normalized lengths L1/H, L2/H and L3/H. The table also presents an example when all normalized voltages are changed by 0.01, which allows compensating both—first and second derivatives T|K and T|KK while keeping $\Delta T/T_0$ magnitudes for higher T|K^n derivatives in the ppm range.

Referring to FIG. 9, there are presented variations of electrode's length and potential at an enforced variation of L4/H at L5/H=2.98 for ion mirror 32 with five electrodes, including one "lens" electrode #5 and an intermediate electrode #4 used for assembly convenience and for stability against electrical breakdown (V4=0). FIG. 9A shows variations of Lcc/H; FIG. 9B—of V4=U4/(K/q); FIG. 9C—of L1/H, L2/H and L3/H; FIG. 7D of V1, V2, and V3; FIG. 7E of angular acceptance of the analyzer versus L4/H. A higher angular acceptance is reached at shortest possible L4/H and even with removal of electrode #4. At large L4/H the lens electrode moves towards the analyzer center and the lens field becomes completely decoupled from the electrostatic field of the reflecting part of the ion mirror. Formally, the analyzer could be referred as another type of the device—a lens within field-free region combined with purely retarding ion mirrors. At L4 extension, the remote lens around electrode #5 has to be weaker (FIG. 9B) to maintain the same type of ion focusing (as in FIG. 3E), such that ion reflection occurs near the ion mirror axis and ions would return to the same initial Y and B coordinates after two mirror reflections.

In a sense, the tested parameters variations correspond to movement of the lens with the adjustment of its strength. Ultimately, the lens electrode may be moved to the center of the drift region. Then the analyzer may be formed by purely retarding mirrors with a single accelerating electrode somewhere in the drift region, or ultimately in the center of the drift region.

Note that in order to maintain fifth-order energy isochronicity, in this simulations of FIG. 9, the normalized lengths and voltages of first three electrodes can be varied in very small range 0.2<L1/H<0.22; 0.32<L2/H<0.35; 0.8<L3/H<0.9; 1.12<V1<1.21; 1.03<V2<1.05; and 0.88<V3<0.93.

Referring to FIG. 10, there are presented variations of electrode's length and potential at an enforced variation of L5/H at L4/H=0.583 for ion mirror 32 with five electrodes, one "lens" electrode #5 and an intermediate electrode #4. FIG. 10A shows variations of Lcc/H; FIG. 10B—of V5=U5/(K/q); FIG. 10C—of L1/H, L2/H and L3/H; FIG. 7D of V1, V2, and V3; FIG. 10E of angular acceptance of the analyzer versus L5/H. A higher angular acceptance is reached at shortest possible L5/H~0.5, however, this requires much higher voltage on electrode #5 which limits the acceleration voltage due to electrical breakdowns and defeats the purpose of reaching higher energy acceptance. Again, variations of lens electrodes require adjustment of the lens voltage such that to maintain the same spatial focusing. In order to maintain fifth-order energy isochronicity, the reflecting part of the ion mirror remains almost unchanged—the normalized lengths and voltages of first three electrodes can be varied in very small range 0.18<L1<0.2; 0.31<L2/H<0.34; 0.77<L3/H<0.82; 1.12<V1<1.22; 1.03<V2<1.05; and 0.84<V3<0.91.

In an attempt for wider range of ion mirror variations, the same studies have been made for the six electrode ion mirror 62.

Referring to FIG. 11, there are presented variations of electrode's length and potential at an enforced variation of L1/H for ion mirror 62 (with six electrodes including two "lens" electrodes) and at Lcc/H=27.68; L4/H=1.33 and L6/H=2.25. The top graph FIG. 11A shows variations of electrodes' length, the middle graph FIG. 11B—of electrode's normalized voltages, and the bottom graph FIG. 11C—of magnitudes for major aberrations at half height Y=1.5 mm (Y/H=0.05), half angle B=3 mrad and relative half energy spread ΔK/K=6%. Note, that L1/H is not limited from the top side, since thus formed long channel no longer affects electrostatic fields in the region of ion reflection. The smallest L1/H (at zero gaps) equals to 0.2. Further shortening of L1 though accompanied by the reduction of major traced aberrations, but causes a significant raise of higher order aberrations. As an example at L1/H=0.17 the maximal reached resolution is 18,000. This is well understood from the main heuristic point of the invention, since penetration of one electrode potential into the reflecting region becomes dominating and can not be compensated by influence of other electrodes.

In simulations presented in FIG. 11, the reflecting part of electrostatic field remains almost unchanged in order to maintain fifth-order energy isochronicity, the lengths and voltages of second and third electrodes can be varied in very small range 0.34<L2/H<0.44; 0.767<L3/H<0.776; 1.18<V1<1.37; 1.03<V2<1.07; and 1.17<V3<1.35.

Referring to FIG. 12, there are presented variations of electrode's length and potential at an enforced variation of L4/H for ion mirror 62 (with six electrodes and two "lens" electrodes) and at single limitation of Lcc/H=27.68. The top graph FIG. 12A shows variations of electrode's length, the middle graph FIG. 12B—of electrode's normalized voltages, and the bottom graph FIG. 12C—of magnitudes for main aberrations at half height Y=1.5 mm (Y/H=0.05), half angle B=3 mrad and relative half energy spread ΔK/K=6%. Fourth electrode could be brought to zero (similarly to previously analyzed ion mirror with five electrodes), since the fifth electrode become playing similar role. However, lowest aberrations are reached at L4/H around 1 to 1.5 (FIG. 12C), which may justify the presence of the electrode #4. The L4 length can be increased even higher than L4/H=2, but the mirror becomes impractical since it requires too high absolute value of V5 voltage. Also note that V5 and V6 curves intersect at L4/H=0.8, which means that two lens electrodes become one with the same potential, which demonstrates the link between simulation series.

Again, the reflecting part of the ion mirror remains almost unchanged in order to maintain fifth-order energy isochronicity, the lengths and voltages of first electrodes can be varied in very small range 0.43<L2/H<0.441; 0.79<L3/H<0.85; 1.29<V1<1.32; V2~1.07; V3~0.91.

Referring to FIG. 13, there are presented variations of electrode's length and potential at an enforced variation of L5/H for ion mirror 62 (with six electrodes and two "lens" electrodes) and at Lcc/H=27.68, L4/H=1.33, and L6/H=2.25. The top graph FIG. 13A shows variations of electrode's length, the middle graph FIG. 13B—of electrode's normalized voltages, and the bottom graph FIG. 13C—of magnitudes for main aberrations at half height Y=1.5 mm (Y/H=0.05), half angle B=3 mrad and relative half energy spread ΔK/K=6%. L5/H can be shortened under 0.1 but it becomes impractical since the absolute value of voltage V5 becomes too high (FIG. 13B). The aberrations are lowered at higher L5/H around 1.5-2 (FIG. 13C), which also requires smaller V5 lens voltage, though at a cost of reduced angular acceptance.

Again, the reflecting part of the ion mirror remains almost unchanged in order to maintain fifth-order energy isochronicity, the lengths and voltages of first three electrodes can be varied in very small range 0.401<L2/H<0.43; 0.78<L3/H<0.8; 1.24<V1<1.29; 1.05<V2<1.06; and 0.9<V3<0.91.

Referring to FIG. 14, there are presented variations of electrode's length and potential at an enforced variation of Lcc/H for ion mirror 62 (with six electrodes and two "lens" electrodes) at single limitation of L4/H=1. The top graph FIG. 14A shows variations of electrode's length, the middle graph FIG. 14B—of electrode's normalized voltages, and the bottom graph FIG. 14C—of magnitudes for main aberrations at half height Y=1.5 mm (Y/H=0.05), half angle B=3 mrad and relative half energy spread ΔK/K=6%. Referring to FIG. 14C, the explored range Lcc/H from 19.4 to 36 (2H/Lcc varies from 0.103 to 0.0555) is limited by an angular acceptance at high end Lcc/H and by too high T|YYK cross term aberration and by a too high absolute value of V5 potential at the low end Lcc/H.

Again, in order to maintain fifth-order energy isochronicity, the reflecting part of the ion mirror remains almost unchanged—lengths of first three electrodes can be varied in very small range 0.4034<L2/H<0.4357 and 0.753<L3/H<0.8228.

Figure 15:
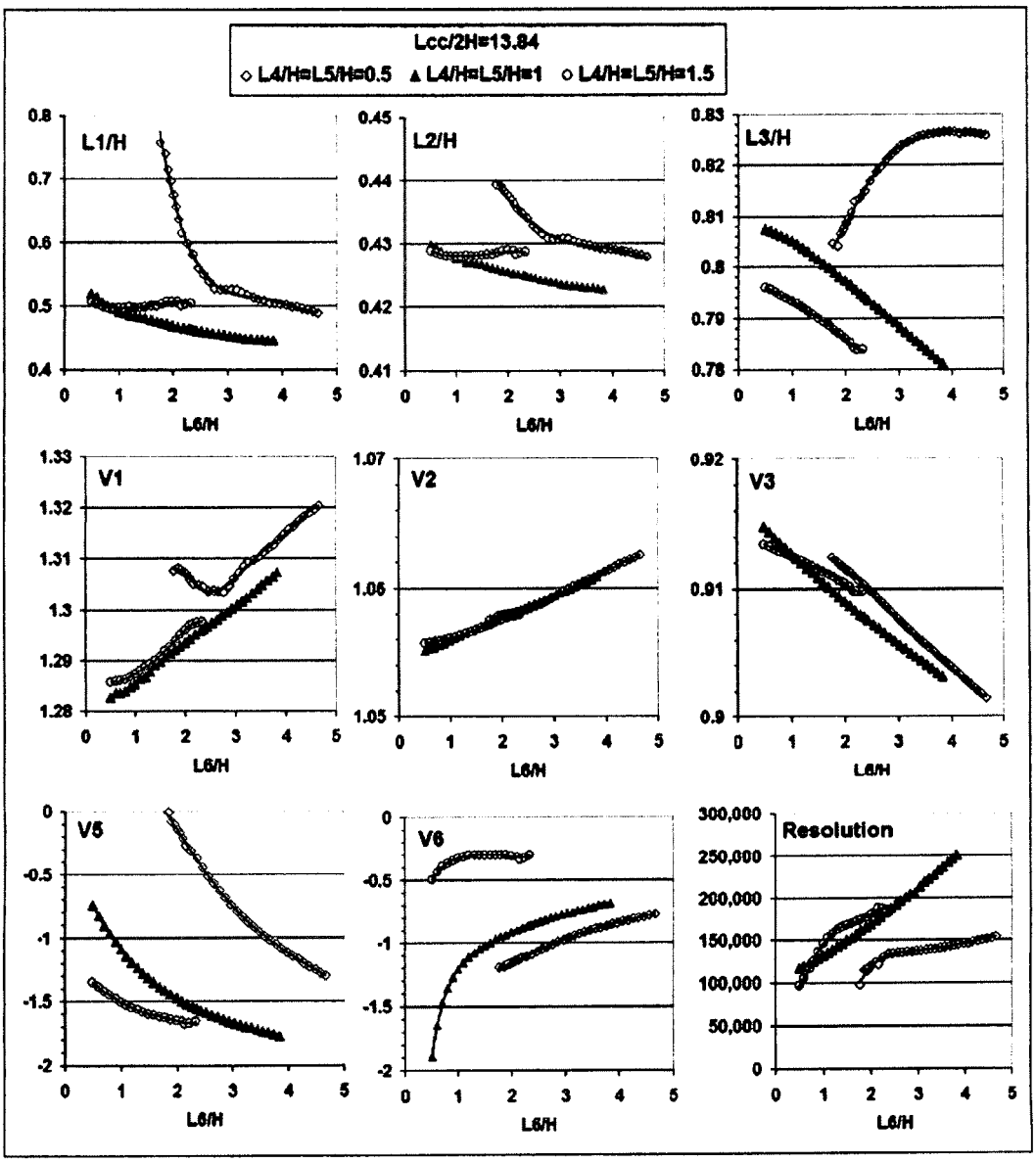
FIG. 15 shows variation of ion mirror parameters at an enforced variation of L5/H and L6/H for ion mirror of FIG. 6 (six electrodes mirror)

Referring to FIG. 15, there are presented variations of electrode's length and potential at an enforced variation of L6/H for ion mirror 62 (with six electrodes and two "lens" electrodes) at Lcc/H=27.68 and for three values of L4/H and L5/H equal to 0.5, 1 and 1.5 in different series annotated by different point signs. Each series has its own pattern of parameter variation. Nevertheless, changes mostly affect lens part of the ion mirror, such that to retain the same type of spatial focusing as in FIG. 3E. The highest resolving power (250,000 for standard packet parameters—half height Y/H=0.05, half angle B=3 mrad and relative half energy spread ΔK/K=6%) in this series is reached at L6/H=3.5, L4/H=LS/H=1. At the same time, the reflecting part of the ion mirror has only minor variations—in order to maintain fifth-order energy isochronicity, lengths of second and third electrodes can be varied in very small range 0.42<L2/H<0.44 and 0.78<L3/H<0.827 and the first three normalized voltages vary as 1.282<V1<1.32, 1.054<V2<1.063, and 0.91<V3<0.915.

Figures 16, 17:
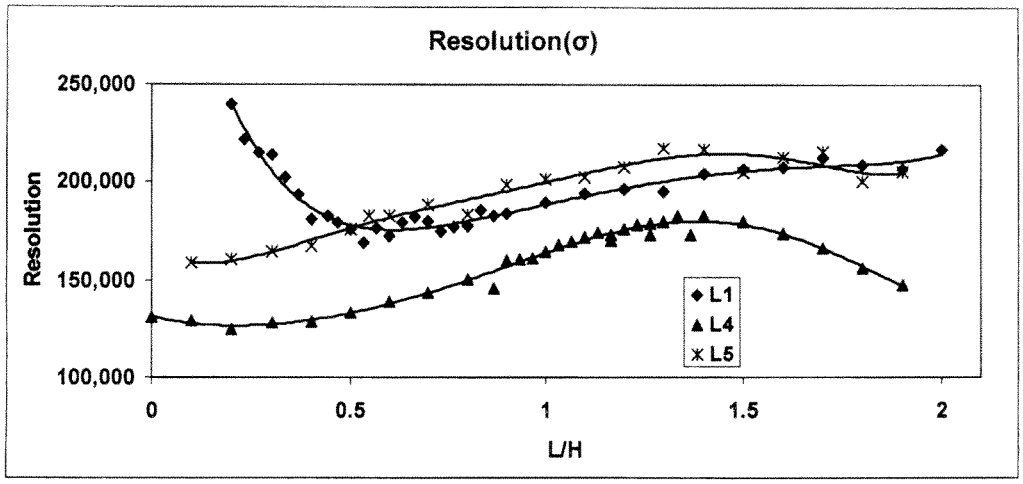
FIG. 16 shows a plot of resolution versus above-presented enforced variations of L1/H, L4/H, and L5/H for ion mirror of FIG. 6 (six electrodes mirror)
FIG. 17 presents summary table on parameters of ion mirror parameters of FIG. 3 to FIG. 15.

Referring to FIG. 16, a summary on resolving power is presented for tested series of ion mirror parameters. A higher resolving power is reached at electrode elongation relative to H, usually accompanied by the elongation of the mirror cap-to-cap distance Lcc and by the reduction of the analyzer angular acceptance (as shown in FIG. 9 and FIG. 10).

Referring to FIG. 17, the table is presented which summarizes the range of parameters variations in FIGS. 2 to 14. Reaching the set of spatial focusing and isochronicity conditions of FIG. 3C at fifth order energy focusing was possible in a limited range of parameters of reflecting part of ion mirrors. The table supports claimed range of parameters. For two identical mirrors with equal height of electrode windows H, the ratio of the second and third electrode lengths L2 and L3 to H are 0.31<L2/H<0.48 and 0.77>L3/H>0.9, and the ratio of potentials at the first three electrodes to mean ion kinetic energy per charge K/q are 1.12<V1<1.37; 1.03<V2<1.07; and 0.84<V3<1.35. In a wider set of experiments, wherein the fifth order focusing is distorted, but the resolving power exceeds R=100,000 for ion packets with half height Y=1.5 mm (Y/H=0.05), half angle B=3 mrad and relative half energy spread ΔK/K=6%, the ion mirror parameters are: 0.2<L2/H<0.5 and 0.6<L3/H<1, and the ratio of potentials at the first three electrodes to mean ion kinetic energy per charge K/q are 1.1<V1<1.4; 1<V2<1.1.

Again referring to FIG. 17, the table also summarizes the degree of potential penetration into the region of ion turning point. The ranges are limited as: $0.185<V_1(X_T)<0.457$; $0.229<V_2(X_T)<0.372$; $0.291<V_3(X_T)<0.405$; $0<V_4(X_T)<0.046$. Since the extremes of parameter ranges could be missed in simulations, and since prior art mirrors had penetration 4% of $3^{rd}$ electrode we suggest 10% as a threshold for optimization.

Figure 18:
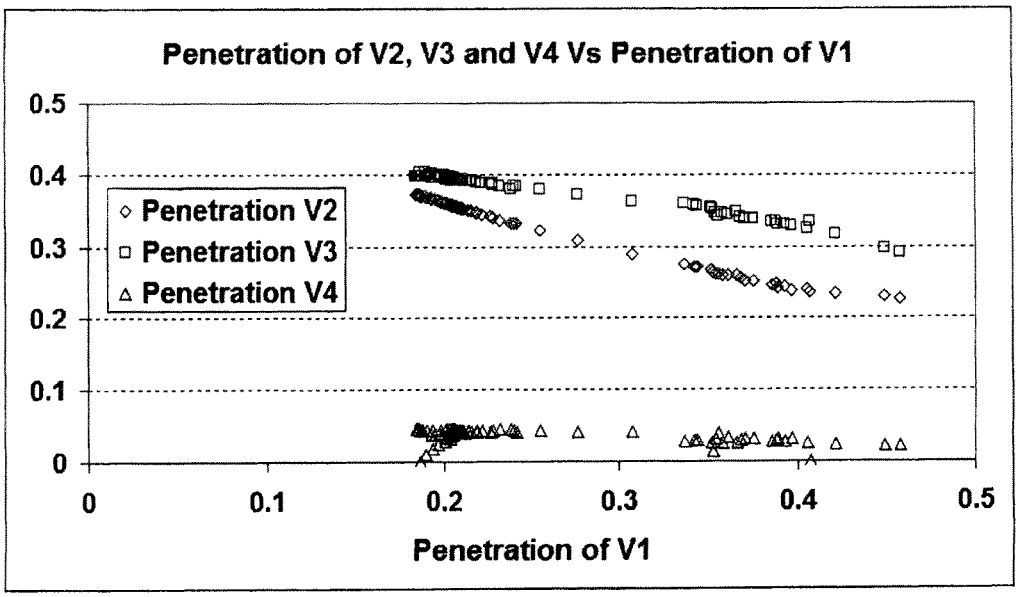
FIG. 18 shows a plot for linked degree of field penetrations for ion mirrors of FIG. 3 to FIG. 17.

Referring to FIG. 18, the degree of field penetration appears linked for all the proposed geometry, which in a sense defines field structure which is necessary for obtaining isochronicity and spatial focusing in FIG. 3C.

The described quality of ion mirrors and described field penetration could be obtained with multiple variations of electrode shapes and of applied potentials, for example, by: (i) making not equal ion mirrors; (ii) introducing gaps between electrodes; (iii) adding electrodes; (iv) making electrodes with unequal window size; (v) making curved electrodes; (vi) using cones or tilted electrodes; (vii) using multiple apertures and printed circuit boards with a distributed potential; (viii) using resistive electrodes; and many other practical modifications; (ix) inserting a lens into field-free space; (x) inserting a sector field into the field-free space. Nevertheless, the quality of the mirror could be reproduced based on the presented parameters of ion mirrors by reproducing their distribution of axial electrostatic field (which causes reproduction of two dimensional field around the axis) or by making electrodes corresponding to equi-potential lines of the described ion mirrors.

Although the present invention has been describing with reference to preferred embodiments, it will be apparent to those skilled in the art that various modifications in form and detail may be made without departing from the scope of the present invention as set forth in the accompanying claims.

What we claim is:

1. An electrostatic isochronous time-of-flight or ion trap analyzer comprising:

two parallel and generally aligned grid-free ion mirrors separated by a drift space, wherein the ion mirrors are substantially elongated in one transverse direction to form a two-dimensional electrostatic field either of a planar symmetry or a hollow cylindrical symmetry, and wherein the ion mirrors includes one or more mirror electrodes having parameters that are selectively adjustable and adjusted to provide less than 0.001% variations of flight time within at least a 10% energy spread for a pair of ion reflections by said ion mirrors.

2. An apparatus as set forth in claim 1, wherein said selectively adjustable parameters of said one or more mirror electrodes comprises one or more of the group consisting of: electrode shapes, electrode sizes, electrode potentials, and a combination thereof.

3. An apparatus as set forth in claim 1, wherein a function of flight time per initial energy has at least four extremums.

4. An apparatus as set forth in claim 1, wherein the at least one electrode with an attracting potential is separated from the at least three electrodes with retarding potential by an electrode with potential of drift region for a sufficient length such that electrostatic fields of the retarding and accelerating portions of the analyzer are decoupled.

5. An electrostatic isochronous time-of-flight or ion trap analyzer comprising:

two parallel and aligned grid-free ion mirrors separated by a drift space, wherein at least one of the ion mirrors includes at least three electrodes with retarding potential, and wherein the ion mirrors are substantially elongated in one transverse direction to form a two-dimensional electrostatic field, and further wherein the electrostatic field has a symmetry that is either planar or hollow cylindrical; and at least one electrode with an accelerating potential compared to the drift space, wherein sizes of the at least three electrodes with retarding potential are selectively adjustable and adjusted to provide potential penetration within a middle electrode window, on optical axis and in a middle region between adjacent electrodes above one tenth of their potential, and wherein, for the purpose of improving resolving power of said electrostatic analyzer, wherein the electrodes of the ion mirrors have parameters that are selectively adjustable and adjusted to provide less than 0.001% variations of flight time within at least a 10% energy spread for a pair of ion reflections by said ion mirrors.

6. An apparatus as set forth in claim 5, wherein the electrodes have equal height H windows, and the ratio of the length L2 and L3 of second and third electrodes (numbered from reflecting mirror end) to H are 0.2≤L2/H≤0.5 and 0.6≤L3/H≤1, wherein the ratio of potentials at the first three electrodes to mean ion kinetic energy per charge K/q are $1.1 \leq V1 \leq 1.4$; $0.95 \leq V2 \leq 1.1$; and $0.8 \leq V3 \leq 1$ and wherein $V1 > V2 > V3$.

7. An apparatus as set forth in claim 6, wherein the lengths of second and third electrodes include half of surrounding gaps with adjacent electrodes.

8. An apparatus as set forth in claim 5, wherein the electrodes are selected from the groups consisting of: (i) thick plates with rectangular window or thick rings; (ii) thin apertures; (iii) tilted electrodes or cones; and (iv) rounded plates or rounded rings.

9. An apparatus as set forth in claim 5, wherein at least some of the electrodes are electrically interconnected, either directly or via resistive chains.

10. An apparatus as set forth in claim 5, wherein the parameters of said mirror electrodes are adjusted to provide less than 0.001% variations of flight time within at least 18% energy spread.

11. An apparatus as set forth in claim 5, wherein a function of flight time per initial energy has at least four extremums.

12. An apparatus as set forth in claim 5, wherein the parameters of the mirror electrodes comprise at least one of:

individual electrode axial potential distribution;

intra-electrode gaps;

aberration coefficients associated with the electrodes;

ion mirror shape;

individual electrode potential;

length of a fourth electrode;

length of a fifth electrode;

length of a first electrode;

ratio of the fourth electrode length to analyzer height;

ratio of the fifth electrode length to the analyzer height; and relative analyzer length per analyzer height.

13. An apparatus as set forth in claim 5, wherein the mirror electrodes are linearly extended in the Z-direction to form two-dimensional planar electrostatic fields.

14. An apparatus as set forth in claim 5, wherein each of the mirror electrodes comprise two coaxial ring electrodes forming a cylindrical field volume between the rings, and wherein potentials on such electrodes are adjusted compared to planar electrodes of the same length.

15. An apparatus as set forth in claim 5, further comprising:

an additional electrode with an attractive potential reducing time-spatial aberrations.

16. An apparatus as set forth in claim 5, wherein the at least one electrode with an attracting potential is separated from the at least three electrodes with retarding potential by an electrode with potential of drift region for a sufficient length such that electrostatic fields of the retarding and accelerating portions of the analyzer are decoupled.

17. A method of mass spectrometric analysis in isochronous multi-reflecting electrostatic fields comprising the following steps:

forming two regions of electrostatic fields between ion mirrors that are separated by field-free space, wherein the ion mirror field is substantially two-dimensional and extended in one direction to have either planar symmetry or a hollow cylindrical symmetry;

forming at least one region with an accelerating field;

within at least one ion mirror field, forming a retarding field region with at least three electrodes at a reflecting end, wherein the three electrodes include retarding potentials such that at the turning point of ions, the mean kinetic energy provides potential penetration above 10%; and adjusting an axial distribution of said ion mirror field to provide less than 0.001% variations of flight time within at least 10% energy spread for a pair of ion reflections by said mirror fields.

18. A method as set forth in claim 17, wherein said step of forming the retarding field comprises a step of choosing an electrode shape such that at the turning point of ions, the mean kinetic energy provides potential penetration above 17%.

19. A method as set forth in claim 18, wherein the retarding field is adjusted such that at turning point of ions, the mean kinetic energy from at least two electrodes provide comparable penetration.

20. A method as set forth in claim 17, wherein the retarding region of said at least one electrostatic ion mirror field corresponds to a field formed with electrodes having lengths L2 and L3 of second and third electrodes (numbered from reflecting mirror end) to electrode window height H are $0.2 \leq L2/H \leq 0.5$ and $0.6 \leq L3/H \leq 1$; wherein the ratio of potentials at the first three electrodes to mean ion kinetic energy per charge K/q are $1.1 \leq V1 \leq 1.4$; $0.95 \leq V2 \leq 1.1$; and $0.8 \leq V3 \leq 1$, and wherein $V1 > V2 > V3$.

21. A method as set forth in claim 17, wherein the structure of the at least one mirror field is adjusted to provide less than 0.001% variations of flight time within at least 18% energy spread.

22. A method as set forth in claim 17, wherein the structure of the at least one mirror field is adjusted such that the function of flight time per initial energy has at least four extremums.

23. A method as set forth in claim 17, wherein the structure of the at least one mirror field is adjusted such that to provide at least forth-order time-per-energy focusing with (T|K)=(T|KK)=(T|KKK)=(T|KKKK)=0, all being expressed with the Taylor expansion coefficients.

24. A method as set forth in claim 17, wherein the structure of the at least one mirror field is adjusted to provide at least the fifth-order time-per-energy focusing with (T|K)=(T|KK)=(T|KKK)=(T|KKKK)=(T|KKKKK)=0, all being expressed with the Taylor expansion coefficients.

25. A method as set forth in claim 17, wherein the structure of the at least one mirror field is adjusted to provide the following conditions after a pair of ion reflections in ion mirrors: (i) spatial and chromatic ion focusing with (Y|B)=(Y|K)=0; (Y|BB)=(Y|BK)=(Y|KK)=0 and (B|Y)=(B|K)=0; (B|YY)=(B|YK)=(B|KK)=0; (ii) first order time of-flight focusing with (T|Y)=(T|B)=(T|K)=0; and (iii) second order time-of-flight focusing, including cross terms with (T|BB)=(T|BK)=(T|KK)=(T|YY)=(T|YK)=(T|YB)=0; all being expressed with the Taylor expansion coefficients.

26. A method as set forth in claim 17, further comprising, after the adjusting step:

introducing a sample for mass spectrometric analysis; and performing ion trap mass spectrometric analysis.

27. A planar ion mirror of an electrostatic isochronous analyzer, comprising:

a first mirror electrode forming a first end of the ion mirror, said first mirror electrode being set with a retarding potential;

a second mirror electrode residing adjacent to said first mirror electrode, said second mirror electrode being set with a retarding potential and said second mirror having a length (L) to window height (H) ratio between 0.2 and 0.5;

a third mirror electrode residing adjacent to said second mirror electrode, said third mirror electrode being set with a retarding potential and said third mirror having a length (L) to window height (H) ratio between 0.6 and 1.0; and a fourth mirror electrode being set with an accelerating potential, wherein each of said mirror electrodes have the same window height (H).

28. The planar ion mirror of claim 27, wherein a normalized voltage (V) applied to said third mirror electrode is less than the normalized voltage applied to both said first mirror electrode and said second mirror electrode, and wherein said normalized voltage being normalized to mean kinetic energy per ion charge by dividing the actual electrode voltage (U) by the ratio (K/q) of ion packet mean energy to ion charge.

29. The planar ion mirror of claim 27, wherein said mirror electrodes provide at least forth-order time-per-energy focusing with (T|K)=(T|KK)=(T|KKK)=(T|KKKK)=0, all being expressed with the Taylor expansion coefficients.

30. The planar ion mirror of claim 27, wherein said mirror electrodes provide at least fifth-order time-per-energy focusing with (T|K)=(T|KK)=(T|KKK)=(T|KKKK)=(T|KKKKK)=0, all being expressed with the Taylor expansion coefficients.

31. The planar ion mirror of claim 27, wherein said mirror electrodes provide the following conditions after a pair of ion reflections in ion mirrors: (i) spatial and chromatic ion focusing with (Y|B)=(Y|K)=0; (Y|BB)=(Y|BK)=(Y|KK)=0 and (B|Y)=(B|K)=0; (B|YY)=(B|YK)=(B|KK)=0; (ii) first order time of-flight focusing with (T|Y)=(T|B)=(T|K)=0; and (iii) second order time-of-flight focusing, including cross terms with (T|BB)=(T|BK)=(T|KK)=(T|YY)=(T|YK)=(T|YB)=0, all being expressed with the Taylor expansion coefficients.

32. The planar ion mirror of claim 27, further comprising:

a fifth mirror electrode residing between said third mirror electrode and said fourth mirror electrode, wherein said first mirror electrode, said second mirror electrode, and said third mirror electrode form a retarding electrostatic field and said fourth mirror electrode forms an accelerating electrostatic field, and wherein said fifth mirror electrode is set with a potential equal to that of a field-free region of the electrostatic isochronous analyzer to decouple the retarding electrostatic field of the mirror from the accelerating electrostatic field of the mirror.

33. The planar ion mirror of claim 32, further comprising:

a sixth mirror electrode being set with an accelerating potential, wherein said fourth mirror electrode resides between said fifth mirror electrode and said sixth mirror electrode.

34. The planar ion mirror of claim 27, wherein the mirror forms a hollow cylinder filled with an electrostatic field.

35. A planar ion mirror of an electrostatic isochronous analyzer, comprising:

a first mirror electrode forming a first end of the ion mirror, said first mirror electrode being set with a retarding potential;

a second mirror electrode residing adjacent to said first mirror electrode, said second mirror electrode being set with a retarding potential and said second mirror having a length (L) to window height (H) ratio between 0.01 and 0.1;

a third mirror electrode residing adjacent to said second mirror electrode, said third mirror electrode being set with a retarding potential and said third mirror having a length (L) to window height (H) ratio between 0.5 and 0.7;

a fourth mirror electrode residing adjacent to said third mirror electrode, said fourth mirror electrode being set with a potential equal to that of a field-free region of the electrostatic isochronous analyzer to decouple a retarding electrostatic field formed by the first, second, and third ion mirrors of the mirror from the accelerating electrostatic field formed by the fifth ion mirror of the mirror; and a fifth mirror electrode being set with an accelerating potential, wherein each of said mirror electrodes have the same window height (H), wherein a first gap is formed between said first mirror electrode and said second mirror electrode, wherein a second gap is formed between said second mirror electrode and said third mirror electrode, and wherein the length (L) of the second mirror electrode is smaller than lengths of both said first gap and said second gap.

36. The planar ion mirror of claim 35, wherein said mirror electrodes provide at least fifth-order time-per-energy focusing with (T|K)=(T|KK)=(T|KKK)=(T|KKKK)=(T|KKKKK)=0, all being expressed with the Taylor expansion coefficients.

37. The planar ion mirror of claim 35, wherein the retarding potential applied to said third mirror electrode is less than both the potential applied to said second mirror electrode and the potential applied to said first mirror electrode.

38. The planar ion mirror of claim 35, wherein a third gap is formed between said third mirror electrode and said fourth mirror electrode, wherein a fourth gap is formed between said fourth mirror electrode and said fifth mirror electrode, and wherein both said third gap and said fourth gap have a length less than one-fifth of the height (H) of said mirror electrode windows.

39. The planar ion mirror of claim 35, wherein said fifth electrode has a length (L) to window height (H) ratio between 1.0 and 4.0.

40. The planar ion mirror of claim 39, wherein said fourth electrode has a length (L) to window height (H) ration between 0.1 and 0.6.

* * * * *